US007199690B2

(12) United States Patent
Hidaka et al.

(10) Patent No.: US 7,199,690 B2
(45) Date of Patent: Apr. 3, 2007

(54) R-T-B SYSTEM RARE EARTH PERMANENT MAGNET

(75) Inventors: Tetsuya Hidaka, Tokyo (JP); Kazuya Sakamoto, Tokyo (JP); Kazuo Sato, Tokyo (JP); Hironari Okada, Tokyo (JP)

(73) Assignee: TDK Corporation, Tokyo (JP)

( * ) Notice: Subject to any disclaimer, the term of this patent is extended or adjusted under 35 U.S.C. 154(b) by 5 days.

(21) Appl. No.: 10/807,889

(22) Filed: Mar. 24, 2004

(65) Prior Publication Data

US 2004/0189426 A1 Sep. 30, 2004

(30) Foreign Application Priority Data

Mar. 27, 2003 (JP) ..... 2003-088195
Jan. 8, 2004 (JP) ..... 2004-003435

(51) Int. Cl.
*H01F 1/053* (2006.01)

(52) U.S. Cl. ..... 335/302; 148/302; 75/244
(58) Field of Classification Search ..... 335/302–306; 148/302; 75/244
See application file for complete search history.

(56) References Cited

U.S. PATENT DOCUMENTS

| | | | | |
|---|---|---|---|---|
| 4,770,723 | A | 9/1988 | Sagawa et al. | |
| 5,645,651 | A | 7/1997 | Fujimura et al. | |
| 6,468,365 | B1 * | 10/2002 | Uchida et al. | 148/302 |
| 2004/0118484 | A1 * | 6/2004 | Nishizawa et al. | 148/302 |

FOREIGN PATENT DOCUMENTS

| | | |
|---|---|---|
| EP | 0 557 103 | 8/1993 |
| EP | 0 753 867 | 1/1997 |
| EP | 0 994 493 | 4/2000 |
| EP | 1 014 392 | 6/2000 |
| EP | 1 164 599 | 12/2001 |
| EP | 1 189 244 | 3/2002 |
| JP | 63-006808 | 1/1988 |
| JP | 07-022227 | 1/1995 |
| JP | 08-069908 | 3/1996 |
| JP | 09-223617 | 8/1997 |
| JP | 10-041113 | 2/1998 |
| JP | 10-259459 | 9/1998 |
| JP | 2000-188213 | 7/2000 |
| JP | 2000-234151 | 8/2000 |
| JP | 2000-252108 | 9/2000 |
| JP | 2001-210508 | 8/2001 |
| JP | 2002-075717 | 3/2002 |
| JP | 2002-287033 | 10/2002 |
| JP | 2002-356701 | 12/2002 |
| JP | 2003-092891 | 3/2003 |
| JP | 2003-217918 | 7/2003 |
| JP | 2003-226944 | 8/2003 |
| JP | 2003-247022 | 9/2003 |
| WO | 00/12771 | 3/2000 |
| WO | 2004/029995 | 4/2004 |
| WO | 2004/029996 | 4/2004 |
| WO | 2004/029997 | 4/2004 |
| WO | 2004/029998 | 4/2004 |
| WO | 2004/029999 | 4/2004 |
| WO | 2004/030000 | 4/2004 |

* cited by examiner

*Primary Examiner*—Ramon M. Barrera
(74) *Attorney, Agent, or Firm*—Hogan & Hartson LLP

(57) ABSTRACT

An R-T-B system rare earth permanent is provided, which comprises a sintered body comprising: an $R_2T_{14}B$ phase (wherein R represents one or more rare earth elements (providing that the rare earth elements include Y) and T represents one or more transition metal elements essentially containing Fe, or Fe and Co) as a main phase; and a grain boundary phase containing a higher amount of R than the above main phase, wherein, when Pc (permeance coefficient) is 2, if a total flux is defined as f1 under the application of an effective magnetic field of 240 kA/m (providing that an effective magnetic field=an applied magnetic field−a demagnetizing field, and each value of them is absolute value), if a total flux is defined as f2 under the application of an effective magnetic field of 800 kA/m, and if a total flux is defined as f3 under the application of an effective magnetic field of 2,000 kA/m, a magnetization rate a (=f1/f3×100) is 40% or more, and a magnetization rate b (=f2/f3×100) is 90% or more.

32 Claims, 33 Drawing Sheets

FIG. 1

[wt%]

| | Nd | Pr | Dy | Co | Cu | Al | B | Zr | Fe |
|---|---|---|---|---|---|---|---|---|---|
| LOW R ALLOY | 23.0 | 6.1 | 0.6 | — | 0.05 | 0.20 | 1.1 | 0.16 | bal. |
| HIGH R ALLOY | 40.3 | – | — | 5.1 | 0.05 | 0.20 | — | – | bal. |
| COMPOSITION OF SINTERED BODY | 24.5 | 5.5 | 0.5 | 0.5 | 0.05 | 0.20 | 1.0 | 0.15 | bal. |

FIG. 2

| SAMPLE NO. | d [μm] | ρ [Mg/m$^3$] | Br [T] | HcJ [kA/m] | (BH)max [kJ/m$^3$] | Hk/HcJ [%] | $O_2$ [ppm] | $N_2$ [ppm] | C [ppm] |
|---|---|---|---|---|---|---|---|---|---|
| 1 | 3.2 | 7.524 | 1.441 | 1120.2 | 399.6 | 97.82 | 760 | 490 | 750 |
| 2 | 3.5 | 7.526 | 1.443 | 1013.5 | 400.6 | 97.36 | 700 | 410 | 710 |
| 3 | 3.7 | 7.525 | 1.442 | 1099.7 | 400.3 | 97.88 | 440 | 380 | 810 |
| 4 | 4.1 | 7.523 | 1.442 | 1070.8 | 400.1 | 97.67 | 570 | 390 | 710 |
| 5 | 4.4 | 7.528 | 1.439 | 1059.6 | 398.5 | 97.95 | 750 | 270 | 810 |

FIG. 3

| MAGNETIZING FIELD (kA/m) | MAGNETIZATION RATE (%) | | | | |
|---|---|---|---|---|---|
| | SAMPLE NO. 1 (d=3.2 μm) | SAMPLE NO. 2 (d=3.5 μm) | SAMPLE NO. 3 (d=3.7 μm) | SAMPLE NO. 4 (d=4.1 μm) | SAMPLE NO. 5 (d=4.4 μm) |
| 0 | 0 | 0 | 0 | 0 | 0 |
| 80 | 8.2 | 10.0 | 10.2 | 9.6 | 7.4 |
| 160 | 18.1 | 28.9 | 27.9 | 28.9 | 17.8 |
| 240 | 36.7 | 49.3 | 49.1 | 49.5 | 38.0 |
| 320 | 49.7 | 66.7 | 67.1 | 68.5 | 54.5 |
| 400 | 60.9 | 75.6 | 75.7 | 77.5 | 65.8 |
| 480 | 69.5 | 81.1 | 81.0 | 82.4 | 73.2 |
| 560 | 74.1 | 84.6 | 84.8 | 85.4 | 78.3 |
| 640 | 79.3 | 88.0 | 88.9 | 89.3 | 82.5 |
| 800 | 86.9 | 93.5 | 93.2 | 93.6 | 89.5 |
| 960 | 93.2 | 96.4 | 96.8 | 97.3 | 94.8 |
| 1200 | 97.7 | 98.1 | 99.1 | 99.1 | 98.6 |
| 1600 | 99.5 | 99.1 | 99.5 | 100 | 99.5 |
| 2000 | 100 | 100 | 100 | 100 | 100 |

d = MEAN GRAIN SIZE

FIG. 5

| MAGNETIZING FIELD (kA/m) | MAGNETIZATION RATE (%) | | | | |
|---|---|---|---|---|---|
| | SAMPLE NO. 1 (d=3.2 μm) | SAMPLE NO. 2 (d=3.5 μm) | SAMPLE NO. 3 (d=3.7 μm) | SAMPLE NO. 4 (d=4.1 μm) | SAMPLE NO. 5 (d=4.4 μm) |
| 40 | 320 | 240 | 240 | 240 | 320 |
| 50 | 400 | 320 | 320 | 320 | 320 |
| 60 | 400 | 320 | 320 | 320 | 400 |
| 70 | 560 | 400 | 400 | 400 | 480 |
| 80 | 800 | 480 | 480 | 480 | 640 |
| 90 | 960 | 800 | 800 | 800 | 960 |
| 95 | 1200 | 960 | 960 | 960 | 1200 |

d = MEAN GRAIN SIZE

FIG. 6

[wt%]

| | Nd | Pr | Dy | Co | Cu | Al | B | Zr | Fe |
|---|---|---|---|---|---|---|---|---|---|
| LOW R ALLOY | 23.0 | 6.1 | 0.6 | – | 0.05 | 0.20 | 1.1 | 0.06 | bal. |
| HIGH R ALLOY | 40.3 | – | – | 5.1 | 0.05 | 0.20 | – | – | bal. |
| COMPOSITION OF SINTERED BODY | 24.5 | 5.5 | 0.5 | 0.5 | 0.05 | 0.20 | 1.0 | 0.05 | bal. |

FIG. 7

| SAMPLE NO. | Ts (°C) | d [μm] | ρ [Mg/m$^3$] | Br [T] | HcJ [kA/m] | (BH)max [kJ/m$^3$] | Hk/HcJ [%] | $O_2$ [ppm] | $N_2$ [ppm] | C [ppm] |
|---|---|---|---|---|---|---|---|---|---|---|
| 6 | 1010 | 4.4 | 7.53 | 1.445 | 1076.2 | 403.2 | 96.68 | 580 | 350 | 710 |
| 7 | 1050 | 4.1 | 7.54 | 1.442 | 1082.6 | 400.5 | 98.02 | 2130 | 270 | 770 |
| 8 | 1070 | 4.3 | 7.55 | 1.438 | 1055.8 | 398.3 | 97.65 | 3430 | 270 | 750 |

FIG. 8

| MAGNETIZING FIELD (kA/m) | MAGNETIZATION RATE (%) | | |
|---|---|---|---|
| | SAMPLE NO. 6 | SAMPLE NO. 7 | SAMPLE NO. 8 |
| 0 | 0 | 0 | 0 |
| 80 | 8.0 | 7.8 | 6.6 |
| 160 | 23.8 | 14.7 | 13.0 |
| 240 | 41.4 | 28.9 | 24.1 |
| 320 | 61.6 | 47.2 | 40.9 |
| 400 | 73.7 | 62.5 | 55.7 |
| 800 | 95.4 | 93.8 | 91.9 |
| 1600 | 100 | 100 | 100 |
| 2000 | 100 | 100 | 100 |

FIG. 10

[wt%]

| SAMPLE NO. | | Nd | Pr | Dy | Co | Cu | Al | B | M(Zr,Ti) | Fe |
|---|---|---|---|---|---|---|---|---|---|---|
| 9 | LOW R ALLOY | 23.0 | 6.1 | 0.55 | — | 0.05 | 0.20 | 1.1 | – | bal. |
| | HIGH R ALLOY | 40.3 | – | — | 5.1 | 0.05 | 0.20 | — | – | bal. |
| | COMPOSITION OF SINTERED BODY | 24.5 | 5.5 | 0.5 | 0.5 | 0.05 | 0.20 | 1.0 | – | bal. |
| 10 | LOW R ALLOY | 23.0 | 6.1 | 0.55 | — | 0.05 | 0.20 | 1.1 | 0.22(Zr) | bal. |
| | HIGH R ALLOY | 40.3 | – | — | 5.1 | 0.05 | 0.20 | — | – | bal. |
| | COMPOSITION OF SINTERED BODY | 24.5 | 5.5 | 0.5 | 0.5 | 0.05 | 0.20 | 1.0 | 0.20 | bal. |
| 11 | LOW R ALLOY | 23.0 | 6.1 | 0.55 | — | 0.05 | 0.20 | 1.1 | 0.22(Ti) | bal. |
| | HIGH R ALLOY | 40.3 | – | — | 5.1 | 0.05 | 0.20 | — | – | bal. |
| | COMPOSITION OF SINTERED BODY | 24.5 | 5.5 | 0.5 | 0.5 | 0.05 | 0.20 | 1.0 | 0.20 | bal. |

FIG. 11

| SAMPLE NO. | Ts (°C) | d [μm] | ρ [Mg/m³] | Br [T] | HcJ [kA/m] | (BH)max [kJ/m³] | Hk/HcJ [%] | $O_2$ [ppm] | $N_2$ [ppm] | C [ppm] |
|---|---|---|---|---|---|---|---|---|---|---|
| 9 | 1070 | 4.3 | 7.53 | 1.435 | 1027.8 | 356.2 | 60.22 | 2000 | 320 | 690 |
| 10 | 1070 | 4.2 | 7.53 | 1.439 | 1088.3 | 400.2 | 98.16 | 1800 | 340 | 650 |
| 11 | 1070 | 4.1 | 7.53 | 1.432 | 1080.1 | 380.2 | 97.67 | 2300 | 240 | 720 |

FIG. 12

| MAGNETIZING FIELD (kA/m) | MAGNETIZATION RATE (%) | | |
|---|---|---|---|
| | SAMPLE NO. 9 | SAMPLE NO. 10 | SAMPLE NO. 11 |
| 0 | 0 | 0 | 0 |
| 80 | 6.3 | 8.9 | 6.5 |
| 160 | 10.9 | 20.3 | 13.6 |
| 240 | 26.4 | 42.5 | 29.9 |
| 320 | 48.2 | 61.0 | 49.8 |
| 400 | 63.1 | 75.4 | 64.9 |
| 800 | 93.6 | 97.2 | 95.6 |
| 1600 | 100 | 100 | 100 |
| 2000 | 100 | 100 | 100 |

FIG. 14

[wt%]

| SAMPLE NO. | | Nd | Pr | Dy | Co | Cu | Al | B | Zr | Fe |
|---|---|---|---|---|---|---|---|---|---|---|
| 12 | LOW R ALLOY | 22.7 | 6.1 | 1.1 | – | 0.05 | 0.20 | 1.1 | 0.15 | bal. |
| | HIGH R ALLOY | 40.3 | – | – | 5.1 | 0.05 | 0.20 | – | – | bal. |
| | COMPOSITION OF SINTERED BODY | 24.5 | 5.5 | 1.0 | 0.5 | 0.05 | 0.20 | 1.0 | 0.14 | bal. |
| 13 | LOW R ALLOY | 29.6 | 6.8 | 0.13 | – | – | 0.22 | 1.1 | – | bal. |
| | HIGH R ALLOY | 55.4 | – | – | 5.0 | 0.07 | – | – | – | bal. |
| | COMPOSITION OF SINTERED BODY | 26.0 | 5.5 | 0.1 | 0.5 | 0.07 | 0.25 | 1.0 | – | bal. |
| 14 | LOW R ALLOY | 21.8 | 6.0 | 2.2 | – | 0.05 | 0.20 | 1.12 | 0.15 | bal. |
| | HIGH R ALLOY | 40.3 | – | – | 5.1 | 0.05 | 0.20 | – | – | bal. |
| | COMPOSITION OF SINTERED BODY | 23.2 | 5.5 | 2.0 | 0.5 | 0.05 | 0.20 | 1.00 | 0.14 | bal. |

FIG. 15

| SAMPLE NO. | Ts (°C) | d [μm] | ρ [Mg/m³] | Br [T] | HcJ [kA/m] | (BH)max [kJ/m³] | Hk/HcJ [%] | $O_2$ [ppm] | $N_2$ [ppm] | C [ppm] |
|---|---|---|---|---|---|---|---|---|---|---|
| 12 | 1060 | 4.3 | 7.53 | 1.407 | 1115.2 | 382.7 | 97.80 | 720 | 390 | 800 |
| 13 | 1040 | 4.3 | 7.52 | 1.403 | 1110.3 | 381.9 | 98.30 | 4800 | 120 | 800 |
| 14 | 1060 | 4.1 | 7.51 | 1.388 | 1335.1 | 367.3 | 98.34 | 830 | 410 | 900 |

FIG. 16

| MAGNETIZING FIELD (kA/m) | MAGNETIZATION RATE (%) | | |
|---|---|---|---|
| | SAMPLE NO. 12 | SAMPLE NO. 13 | SAMPLE NO. 14 |
| 0 | 0 | 0 | 0 |
| 80 | 8.6 | 5.5 | 11.2 |
| 160 | 27.8 | 10.5 | 31.4 |
| 240 | 54.3 | 24.1 | 55.5 |
| 320 | 73.5 | 41.8 | 72.3 |
| 400 | 83.5 | 60.3 | 80.4 |
| 480 | 87.7 | 73.4 | 85.0 |
| 560 | 90.4 | 82.3 | 88.4 |
| 640 | 92.7 | 88.2 | 91.2 |
| 800 | 96.2 | 94.9 | 95.9 |
| 960 | 98.1 | 98.3 | 97.9 |
| 1200 | 99.4 | 100 | 99.4 |
| 1600 | 100 | 100 | 99.6 |
| 2000 | 100 | 100 | 100 |

FIG. 20

| SAMPLE NO. | Ts (°C) | d [μm] | ρ [Mg/m³] | Br [T] | HcJ [kA/m] | (BH)max [kJ/m³] | Hk/HcJ [%] | $O_2$ [ppm] | $N_2$ [ppm] | C [ppm] |
|---|---|---|---|---|---|---|---|---|---|---|
| 15 | 1060 | 4.2 | 7.52 | 1.441 | 1074.3 | 401.9 | 97.53 | 790 | 450 | 880 |

FIG. 21

| MAGNETIZING FIELD (kA/m) | MAGNETIZATION RATE (%) | | |
|---|---|---|---|
| | Pc=2.0 | Pc=1.0 | Pc=0.5 |
| 0 | 0 | 0 | 0 |
| 80 | 10.9 | 8.5 | 6.3 |
| 160 | 30.4 | 25.9 | 17.5 |
| 240 | 52.8 | 47.6 | 34.9 |
| 320 | 69.2 | 63.1 | 50.8 |
| 800 | 95.2 | 93.3 | 83.3 |
| 1600 | 100 | 99.7 | 99.2 |
| 2000 | 100 | 100 | 100 |

FIG. 23

[wt%]

| | Nd | Pr | Dy | Tb | Co | Cu | Al | B | Nb | Fe |
|---|---|---|---|---|---|---|---|---|---|---|
| COMPOSITION 1 | 27.73 | – | – | 3.58 | 0.59 | 0.13 | 0.25 | 1.01 | 0.70 | bal. |

FIG. 24

| SAMPLE NO. | d [μm] | ρ [Mg/m³] | Br [T] | HcJ [kA/m] | (BH)max [kJ/m³] | Hk/HcJ [%] | $O_2$ [ppm] | $N_2$ [ppm] | C [ppm] | REMARKS |
|---|---|---|---|---|---|---|---|---|---|---|
| 18 | 3.3 | 7.585 | 1.319 | 2205 | 337.8 | 90.9 | 960 | 450 | 920 | COMPOSITION 1 |
| 19 | 3.7 | 7.594 | 1.317 | 2179 | 340.1 | 95.4 | 840 | 420 | 880 | |
| 20 | 4.1 | 7.589 | 1.316 | 2151 | 341.0 | 96.0 | 820 | 400 | 900 | |
| 21 | 4.4 | 7.592 | 1.316 | 2138 | 340.2 | 94.9 | 770 | 370 | 870 | |
| 22 | 4.8 | 7.586 | 1.315 | 2104 | 340.6 | 94.5 | 780 | 360 | 870 | |
| 23 | 5.3 | 7.581 | 1.315 | 2066 | 339.3 | 94.0 | 750 | 350 | 890 | |

FIG. 25

| MAGNETIZING FIELD (kA/m) | MAGNETIZATION RATE (%) | | | | | |
|---|---|---|---|---|---|---|
| | SAMPLE NO. 18 (d=3.3 μm) | SAMPLE NO. 19 (d=3.7 μm) | SAMPLE NO. 20 (d=4.1 μm) | SAMPLE NO. 21 (d=4.4 μm) | SAMPLE NO. 22 (d=4.8 μm) | SAMPLE NO. 23 (d=5.3 μm) |
| 0 | 0 | 0 | 0 | 0 | 0 | 0 |
| 80 | 9.9 | 13.3 | 13.6 | 13.2 | 12.8 | 10.8 |
| 160 | 31.2 | 37.4 | 39.1 | 39.0 | 37.9 | 34.3 |
| 240 | 53.2 | 65.9 | 68.2 | 67.4 | 65.4 | 57.2 |
| 320 | 73.4 | 82.5 | 83.6 | 83.2 | 82.8 | 76.5 |
| 400 | 83.3 | 88.4 | 90.0 | 90.3 | 88.8 | 84.2 |
| 560 | 91.2 | 94.5 | 95.1 | 95.2 | 94.6 | 92.2 |
| 800 | 95.6 | 98.1 | 98.2 | 97.8 | 97.9 | 96.4 |
| 1200 | 99.1 | 100 | 100.0 | 100 | 100 | 99.1 |
| 1600 | 100 | 100 | 100.0 | 100 | 100 | 100 |
| 2000 | 100 | 100 | 100.0 | 100 | 100 | 100 |

FIG. 26

[wt%]

| | Nd | Pr | Dy | Tb | Co | Cu | Al | B | Nb | Fe |
|---|---|---|---|---|---|---|---|---|---|---|
| COMPOSITION 2 | 25.53 | – | – | 4.78 | 0.59 | 0.13 | 0.25 | 1.01 | 0.70 | bal. |

FIG. 27

| SAMPLE NO. | d [μm] | ρ [Mg/m³] | Br [T] | HcJ [kA/m] | (BH)max [kJ/m³] | Hk/HcJ [%] | $O_2$ [ppm] | $N_2$ [ppm] | C [ppm] | REMARKS |
|---|---|---|---|---|---|---|---|---|---|---|
| 24 | 4.2 | 7.598 | 1.307 | 2432 | 332.3 | 95.8 | 490 | 390 | 810 | COMPOSITION 2 |
| 25 | 4.1 | 7.596 | 1.307 | 2440 | 332.6 | 97.0 | 910 | 370 | 820 | |
| 26 | 4.1 | 7.593 | 1.306 | 2422 | 333.5 | 97.4 | 1350 | 340 | 800 | |
| 27 | 4.1 | 7.594 | 1.306 | 2399 | 331.7 | 96.8 | 1890 | 300 | 830 | |
| 28 | 4.0 | 7.585 | 1.303 | 2335 | 331.5 | 96.6 | 2580 | 180 | 820 | |

FIG. 28

| MAGNETIZING FIELD (kA/m) | MAGNETIZATION RATE (%) | | | | |
|---|---|---|---|---|---|
| | SAMPLE NO. 24 ($O_2$=490) | SAMPLE NO. 25 ($O_2$=910) | SAMPLE NO. 26 ($O_2$=1350) | SAMPLE NO. 27 ($O_2$=1890) | SAMPLE NO. 28 ($O_2$=2580) |
| 0 | 0 | 0 | 0 | 0 | 0 |
| 80 | 17.3 | 16.0 | 15.4 | 14.1 | 11.9 |
| 160 | 56.2 | 55.7 | 52.4 | 49.4 | 42.1 |
| 240 | 79.1 | 78.3 | 75.3 | 70.2 | 59.0 |
| 320 | 90.4 | 89.6 | 86.2 | 82.9 | 76.3 |
| 400 | 94.5 | 94.3 | 93.1 | 91.1 | 83.4 |
| 560 | 97.6 | 97.2 | 96.9 | 96.5 | 91.8 |
| 800 | 100 | 99.1 | 100 | 99.1 | 96.5 |
| 1200 | 100 | 100 | 100 | 100 | 99.1 |
| 1600 | 100 | 100 | 100 | 100 | 100 |
| 2400 | 100 | 100 | 100 | 100 | 100 |

FIG. 29

[wt%]

| | Nd | Pr | Dy | Tb | Co | Cu | Al | B | M | Fe |
|---|---|---|---|---|---|---|---|---|---|---|
| COMPOSITION 1 | 27.73 | – | – | 3.58 | 0.59 | 0.13 | 0.25 | 1.0 | Nb=0.7 | bal. |
| COMPOSITION 3 | 27.85 | – | – | 3.62 | 0.57 | 0.14 | 0.24 | 1.0 | – | bal. |
| COMPOSITION 4 | 27.69 | – | – | 3.55 | 0.60 | 0.13 | 0.25 | 1.0 | Nb=1.4 | bal. |
| COMPOSITION 5 | 27.83 | – | – | 3.58 | 0.57 | 0.13 | 0.25 | 1.0 | Zr=0.15 | bal. |
| COMPOSITION 6 | 27.78 | – | – | 3.51 | 0.59 | 0.14 | 0.25 | 1.0 | Ta=0.7 | bal. |
| COMPOSITION 7 | 27.87 | – | – | 3.55 | 0.55 | 0.13 | 0.24 | 1.0 | Bi=0.07 | bal. |
| COMPOSITION 8 | 27.89 | – | – | 3.5 | 0.59 | 0.13 | 0.23 | 1.0 | Ga=0.5 | bal. |
| COMPOSITION 9 | 27.74 | – | – | 3.64 | 0.55 | 0.14 | 0.26 | 1.0 | Sn=0.7 | bal. |
| COMPOSITION 10 | 27.80 | – | – | 3.48 | 0.54 | 0.13 | 0.24 | 1.0 | Zr=0.1<br>Nb=0.2 | bal. |

FIG. 30

| SAMPLE NO. | d [μm] | ρ [Mg/m³] | Br [T] | HcJ [kA/m] | (BH)max [kJ/m³] | Hk/HcJ [%] | $O_2$ [ppm] | $N_2$ [ppm] | C [ppm] | REMARKS |
|---|---|---|---|---|---|---|---|---|---|---|
| 18 | 4.1 | 7.589 | 1.316 | 2151 | 341.0 | 96.0 | 820 | 400 | 900 | COMPOSITION 1 |
| 29 | 4.3 | 7.577 | 1.34 | 2044 | 352.5 | 93.6 | 1360 | 370 | 820 | COMPOSITION 3 |
| 30 | 4.0 | 7.583 | 1.301 | 2246 | 329.4 | 97.6 | 1140 | 390 | 850 | COMPOSITION 4 |
| 31 | 3.9 | 7.585 | 1.338 | 2064 | 355.4 | 95.1 | 950 | 400 | 860 | COMPOSITION 5 |
| 32 | 4.2 | 7.579 | 1.314 | 2167 | 339.8 | 96.5 | 1010 | 380 | 880 | COMPOSITION 6 |
| 33 | 4.6 | 7.582 | 1.336 | 2134 | 353.2 | 95.9 | 1220 | 370 | 840 | COMPOSITION 7 |
| 34 | 4.2 | 7.576 | 1.324 | 2287 | 345.0 | 96.2 | 990 | 410 | 850 | COMPOSITION 8 |
| 35 | 4.1 | 7.580 | 1.321 | 2196 | 342.6 | 95.6 | 1040 | 390 | 880 | COMPOSITION 9 |
| 36 | 3.9 | 7.585 | 1.331 | 2144 | 350.1 | 97.1 | 1250 | 420 | 840 | COMPOSITION 10 |

FIG. 31

| MAGNETIZING FIELD (kA/m) | MAGNETIZATION RATE (%) | | | | | | | | |
|---|---|---|---|---|---|---|---|---|---|
| | SAMPLE NO. 18 (Nb=0.7) | SAMPLE NO. 29 — | SAMPLE NO. 30 (Nb=1.4) | SAMPLE NO. 31 (Zr=0.15) | SAMPLE NO. 32 (Ta=0.7) | SAMPLE NO. 33 (Bi=0.07) | SAMPLE NO. 34 (Ga=0.5) | SAMPLE NO. 35 (Sn=0.7) | SAMPLE NO. 36 Zr=0.1 Nb=0.2 |
| 0 | 0 | 0 | 0 | 0 | 0 | 0 | 0 | 0 | 0 |
| 80 | 13.6 | 9.9 | 14.5 | 13.8 | 12.8 | 12.4 | 13.1 | 13.3 | 14.7 |
| 160 | 39.1 | 28.4 | 40.6 | 40.2 | 37.4 | 36.1 | 38.6 | 37.9 | 41 |
| 240 | 68.2 | 49.8 | 68.7 | 69 | 64.3 | 62.2 | 67.8 | 68 | 69.2 |
| 320 | 83.6 | 71.8 | 84 | 84.2 | 80.4 | 77.8 | 83.6 | 84 | 84.2 |
| 400 | 90.0 | 83.5 | 90.7 | 91.0 | 88.4 | 87.8 | 90.3 | 90.3 | 91 |
| 560 | 94.5 | 91.2 | 95.5 | 95.5 | 94.1 | 93.9 | 95.5 | 95.5 | 95.6 |
| 800 | 98.2 | 94.7 | 98.2 | 99.1 | 97.7 | 96.9 | 98.2 | 98.2 | 99.1 |
| 1600 | 100.0 | 98.7 | 100 | 100 | 99.1 | 99.1 | 100 | 100 | 100 |
| 2000 | 100.0 | 100 | 100 | 100 | 100 | 100 | 100 | 100 | 100 |

FIG. 32

[wt%]

| | Nd | Pr | Dy | Tb | Co | Cu | Al | B | Nb | Fe |
|---|---|---|---|---|---|---|---|---|---|---|
| COMPOSITION 11 | 26.5 | 3.1 | 2.0 | – | 0.7 | 0.08 | 0.25 | 1.0 | – | bal. |
| COMPOSITION 12 | 24.2 | 3.0 | 4.4 | — | 0.7 | 0.08 | 0.25 | 1.0 | – | bal. |
| COMPOSITION 13 | 22.8 | 2.9 | 5.8 | — | 0.7 | 0.08 | 0.25 | 1.0 | – | bal. |
| COMPOSITION 14 | 20.5 | 2.9 | 8.1 | — | 0.7 | 0.08 | 0.25 | 1.0 | – | bal. |

FIG. 33

| SAMPLE NO. | d [μm] | ρ [Mg/m$^3$] | Br [T] | HcJ [kA/m] | (BH)max [kJ/m$^3$] | Hk/HcJ [%] | $O_2$ [ppm] | $N_2$ [ppm] | C [ppm] | REMARKS |
|---|---|---|---|---|---|---|---|---|---|---|
| 37 | 4.1 | 7.539 | 1.383 | 1196 | 366.2 | 97.3 | 1770 | 110 | 790 | COMPOSITION 11 |
| 38 | 4.1 | 7.577 | 1.301 | 1698 | 326.5 | 96.8 | 1810 | 110 | 820 | COMPOSITION 12 |
| 39 | 4.0 | 7.581 | 1.262 | 2015 | 293.8 | 97.1 | 1690 | 120 | 770 | COMPOSITION 13 |
| 40 | 4.1 | 7.594 | 1.201 | 2435 | 271.4 | 97.0 | 1820 | 100 | 770 | COMPOSITION 14 |

FIG. 34

| MAGNETIZING FIELD (kA/m) | MAGNETIZATION RATE (%) | | | |
|---|---|---|---|---|
| | SAMPLE NO. 37 (Dy=2.0) | SAMPLE NO. 38 (Dy=4.4) | SAMPLE NO. 39 (Dy=5.8) | SAMPLE NO. 40 (Dy=8.1) |
| 0 | 0 | 0 | 0 | 0 |
| 80 | 11.0 | 12.1 | 13.5 | 15.4 |
| 160 | 28.7 | 35.4 | 36.9 | 40.2 |
| 240 | 52.1 | 62.2 | 65.4 | 68.1 |
| 320 | 69.5 | 78.5 | 83.1 | 85 |
| 400 | 83.2 | 88.2 | 90.9 | 93.1 |
| 560 | 92.1 | 94.7 | 96.7 | 98.4 |
| 800 | 97.4 | 99.1 | 99.8 | 100 |
| 1600 | 99.1 | 100 | 100 | 100 |
| 2000 | 100 | 100 | 100 | 100 |

FIG. 36

[wt%]

| | Nd | Pr | Dy | Tb | Co | Cu | Al | B | Nb | Fe |
|---|---|---|---|---|---|---|---|---|---|---|
| COMPOSITION 15 | 27.3 | 3.0 | — | 0.7 | 0.7 | 0.08 | 0.25 | 1.0 | – | bal. |
| COMPOSITION 16 | 26.7 | 3.0 | — | 1.2 | 0.7 | 0.08 | 0.25 | 1.0 | – | bal. |
| COMPOSITION 17 | 24.0 | 2.9 | — | 3.6 | 0.7 | 0.08 | 0.25 | 1.0 | – | bal. |
| COMPOSITION 18 | 22.6 | 3.0 | – | 5.0 | 0.7 | 0.08 | 0.25 | 1.0 | – | bal. |

FIG. 37

| SAMPLE NO. | d [μm] | ρ [Mg/m³] | Br [T] | HcJ [kA/m] | (BH)max [kJ/m³] | Hk/HcJ [%] | $O_2$ [ppm] | $N_2$ [ppm] | C [ppm] | REMARKS |
|---|---|---|---|---|---|---|---|---|---|---|
| 41 | 4.1 | 7.542 | 1.396 | 1253 | 379.2 | 96.9 | 1710 | 130 | 760 | COMPOSITION 15 |
| 42 | 4.2 | 7.558 | 1.380 | 1398 | 370.4 | 97.2 | 1920 | 120 | 780 | COMPOSITION 16 |
| 43 | 4.0 | 7.579 | 1.321 | 2090 | 339.5 | 96.6 | 1740 | 130 | 760 | COMPOSITION 17 |
| 44 | 4.3 | 7.588 | 1.282 | 2488 | 320.1 | 96.7 | 1800 | 110 | 770 | COMPOSITION 18 |

FIG. 38

| MAGNETIZING FIELD (kA/m) | MAGNETIZATION RATE (%) | | | |
|---|---|---|---|---|
| | SAMPLE NO. 41 (Tb=0.7) | SAMPLE NO. 42 (Tb=1.2) | SAMPLE NO. 43 (Tb=3.6) | SAMPLE NO. 44 (Tb=5.0) |
| 0 | 0 | 0 | 0 | 0 |
| 80 | 10.2 | 12.2 | 13.2 | 14.7 |
| 160 | 26.7 | 32.5 | 36.1 | 39 |
| 240 | 51.7 | 60.9 | 63.4 | 65.2 |
| 320 | 70.2 | 76.2 | 78.9 | 80.8 |
| 400 | 82.1 | 85.4 | 87.0 | 89.3 |
| 560 | 90.0 | 92.6 | 94 | 95.4 |
| 800 | 95.2 | 97.1 | 98.3 | 99.1 |
| 1600 | 99.1 | 100 | 100 | 100 |
| 2000 | 100 | 100 | 100 | 100 |

FIG. 39

| MAGNETIZING FIELD (kA/m) | MAGNETIZATION RATE (%) | | |
|---|---|---|---|
| | SAMPLE NO. 19 (Pc=2.0) | SAMPLE NO. 45 (Pc=1.0) | SAMPLE NO. 46 (Pc=0.5) |
| 0 | 0 | 0 | 0 |
| 80 | 13.3 | 10.4 | 7.3 |
| 160 | 37.4 | 31.9 | 21.8 |
| 240 | 65.9 | 58.7 | 44.2 |
| 320 | 82.5 | 76.3 | 60.9 |
| 400 | 88.4 | 84.2 | 70.8 |
| 560 | 94.5 | 91.6 | 81.2 |
| 800 | 98.1 | 96.3 | 89.5 |
| 1600 | 100 | 100 | 99.1 |
| 2000 | 100 | 100 | 100 |

R-T-B SYSTEM RARE EARTH PERMANENT MAGNET

BACKGROUND OF THE INVENTION

1. Field of the Invention

The present invention relates to an R-T-B system rare earth permanent magnet (wherein R represents one or more rare earth elements (providing that the rare earth elements include Y), and T represents one or more transition metal elements essentially comprising Fe, or Fe and Co), and especially relates to an R-T-B system rare earth permanent magnet with high magnetizability.

2. Description of the Related Art

Among rare earth permanent magnets, an R-T-B system rare earth permanent magnet has been adopted in various types of electric equipment for the reasons that its magnetic properties are excellent and that its main component Nd is abundant as a source and relatively inexpensive.

Research and development directed towards the improvement of the magnetic properties of the R-T-B system rare earth permanent magnet, more specifically, the improvement of a residual flux density, a coercive force and a maximum energy product, have mainly progressed. However, magnetizability has recently become a focus of attention in such research and development. To saturate a magnetization, the R-T-B system rare earth permanent magnet requires a magnetizing field higher than that of a ferrite magnet. For example, when a ring-formed R-T-B system rare earth permanent magnet is used as a rotator of a motor, there are some cases where the ring-formed R-T-B system rare earth permanent magnet is incorporated into the motor and a coil for a motor is then wound around the ring-formed R-T-B system rare earth permanent magnet for magnetization. When the motor is small, in order to obtain a certain number of windings, the diameter of a coil wire becomes thin, and thus, a high current cannot be passed through the coil. Accordingly, a sufficient magnetizing field cannot be applied to an R-T-B system rare earth permanent magnet. Therefore, an R-T-B system rare earth permanent magnet used for the above purpose is required to have as high as possible magnetizability in a low magnetizing field.

For example, Japanese Patent Laid-Open No. 2002-356701 discloses an R-T-B system rare earth permanent magnet with excellent magnetizability, which is a sintered body of rare earth alloy, the mean composition of the main phase of which is represented by $(LR_{1-x}HR_x)_2T_{14}A$ (wherein T represents Fe or a mixture of Fe and at least one transition metal element other than Fe, A represents boron or a mixture of boron and carbon, LR represents at least one light rare earth element, HR represents at least one heavy rare earth element, and $0<x<1$). This rare earth alloy sintered body comprises crystal grains having a plurality of at least one of the first main phase consisting of a composition represented by $(LR_{1-p}HR_p)_2T_{14}A$ ($0\leqq p<x$) and the second main phase consisting of a composition represented by $(LR_{1-q}HR_q)_2T_{14}A$ ($0\leqq q<1$).

Japanese Patent Laid-Open No. 2002-356701 discloses a technique for improving magnetizability without decreasing magnetic properties. However, a magnetizing field of approximately 0.8 MA/m (10 kOe) is required to obtain a magnetization rate of approximately 50%. Therefore, it is desired to obtain a magnetization rate of approximately 50% in a lower magnetizing field.

Moreover, Japanese Patent Laid-Open No. 2003-217918 discloses a rare earth sintered magnet, which comprises, for the purpose of improving magnetizability, 25% to 35% by weight of R (wherein R represents at least one rare earth element (providing that the rare earth elements include Y) and Nd occupies 50 or more atom % of R), 0.8% to 1.5% by weight of B, 8% or less by weight of M (at least one selected from a group consisting of Ti, Cr, Ga, Mn, Co, Ni, Cu, Zn, Nb and Al) as necessary, the balance T (Fe, or Fe and Co), and inevitable impurities. This rare earth sintered magnet has crystal structure in which an Fe phase comprising 80 or more at % of $Fe_ACo_{1-A}$ remains at a size of 0.01 to 300 μm in the sintered body. The rare earth sintered magnet has a magnetization rate Br (0.2 MA/m)/Br (2.0 MA/m) of 59% or more, which is evaluated with a residual flux density, and a magnetization rate ϕ, (0.3 MA/m)/ϕ (4.0 MA/m), of 4% or more, which is evaluated with a flux.

However, the above values obtained in Japanese Patent Laid-Open No. 2003-217918, that is, a magnetization rate Br (0.2 MA/m)/Br (2.0 MA/m) of 59% or more, which is evaluated with a residual flux density, and a magnetization rate ϕ, (0.3 MA/m)/ϕ (4.0 MA/m), of 4% or more, are not considered to be good magnetizability.

According to the studies of the present inventors, with regard to an R-T-B system rare earth permanent magnet having a high magnetization rate in a low magnetic field, a magnetization characteristic curve indicating a fluctuation in a magnetization rate by a magnetizing field tends to gently incline. This is to say, a higher magnetizing field is required to reach a magnetization rate close to 100%, and it is not desired.

BRIEF SUMMARY OF THE INVENTION

The present invention has been made to achieve these technical objects. Hence, it is an object of the present invention to provide an R-T-B system rare earth permanent magnet, which has a high magnetization rate in a low magnetizing field and has a magnetization characteristic curve showing an early rising edge to reach a magnetization rate close to 100%, for example, a magnetization rate of approximately 90%.

It has been previously known that when a permanent magnet is intended to obtain a high coercive force, its residual flux density becomes low, but when it is intended to obtain a high residual flux density, its coercive force becomes low. Accordingly, for example, the amount of Dy contained as a rare earth element in a permanent magnet is adjusted, so as to obtain desired properties. More specifically, when a high coercive force is intended to obtain, the amount of Dy is increased, and when a high residual flux density is intended to obtain, the amount of Dy is decreased, so that desired properties are obtained. It has been empirically known that a permanent magnet with a high coercive force has high magnetizability.

The present inventors have studied a magnet, which comprises a sintered body comprising an $R_2T_{14}B$ phase (wherein R represents one or more rare earth elements (providing that the rare earth elements include Y) and T represents one or more transition metal elements essentially comprising Fe, or Fe and Co) as a main phase and a grain boundary phase containing a higher amount of R than the above main phase. As a result, the present inventors have found that the mean grain size of a sintered body and the content of oxygen in the sintered body are controlled and that Zr and/or Nb are contained therein, so as to obtain excellent magnetizability, which have never been obtained.

These findings can also be applied to a permanent magnet with a relatively low coercive force (hereinafter referred to as a "low coercive force type") and a permanent magnet with a relatively high coercive force (hereinafter referred to as a "high coercive type"). In terms of magnetizability, the low coercive force type permanent magnet and the high coercive force type permanent magnet will be described below in this order. As described later, the high coercive force type permanent magnet has higher magnetizability. First, the low coercive force type permanent magnet of the present invention will be explained.

With regard to the R-T-B system rare earth permanent magnet of the present invention (hereinafter the R-T-B system rare earth permanent magnet being simply referred to as a "permanent magnet"), when Pc (permeance coefficient) is 2, if a total flux is defined as f1 under the application of an effective magnetic field of 240 kA/m (3 kOe) (providing that an effective magnetic field=an applied magnetic field−a demagnetizing field, and note that each value of them is absolute value, if a total flux is defined as f2 under the application of an effective magnetic field of 800 kA/m (10 kOe), and if a total flux is defined as f3 under the application of an effective magnetic field of 2,000 kA/m (25 kOe), a magnetization rate a (=f1/f3×100) is 40% or more, and a magnetization rate b (=f2/f3×100) is 90% or more (the first permanent magnet) Here, Pc is a reciprocal number of magnetic resistance.

The first permanent magnet of the present invention can realize high magnetizability such that when Pc is 0.5, a magnetization rate a is 30% or more and a magnetization rate b is 80% or more, and when Pc is 1, the magnetization rate a is 35% or more and the magnetization rate b is 90% or more.

This permanent magnet can be assured to have properties with a residual flux density (Br) of 1.35 T or more, a maximum energy product ((BH) max) of 350 kJ/$m^3$ or more, and a squareness (Hk/HcJ) of 95% or more.

In order that the first permanent magnet of the present invention obtains the above excellent magnetizability, it is important that the amount of oxygen is 2,000 ppm or less, and more preferably 1,500 ppm or less in a sintered body, and that the mean grain size of the sintered body is between 3.3 and 4.3 μm. Moreover, in order to obtain the above excellent magnetizability, it is also important that Zr is dispersed in the sintered body.

The first permanent magnet of the present invention is desirably applied to a permanent magnet comprising a sintered body with a composition comprising of 25% to 35% by weight of R (wherein R represents one or more rare earth elements (providing that the rare earth elements include Y)), 0.5% to 4.5% by weight of B, 0.02% to 0.5% by weight of Al and/or Cu, 0.03% to 0.25% by weight of Zr, 2% or less by weight of Co (excluding 0), and the balance substantially being Fe.

The first permanent magnet of the present invention may comprise 0.1% to 4.0% by weight of Dy as R.

In addition, the first permanent magnet of the present invention comprises Zr. This Zr is dispersed at least in the grain boundary phase of the sintered body.

Moreover, the first permanent magnet of the present invention relates to a low coercive force type permanent magnet having a coercive force (HcJ) of 1,680 kA/m (21 kOe) or less.

As stated above, although the permanent magnet of the present invention with the first feature is a low coercive force type permanent magnet, its magnetizability can be improved.

Now, a high coercive force type permanent magnet will be explained below.

With regard to the high coercive force type permanent magnet of the present invention, when Pc is 2, if a total flux is defined as F1 under the application of an effective magnetic field of 240 kA/m (3 kOe), if a total flux is defined as F2 under the application of an effective magnetic field of 400 kA/m (5 kOe), and if a total flux is defined as F3 under the application of an effective magnetic field of 2,000 kA/m (25 kOe), a magnetization rate c (=F1/F3×100) is 60% or more, and a magnetization rate d (=F2/F3×100) is 85% or more (the second permanent magnet).

As stated above, it has been empirically known that a permanent magnet with a high coercive force has high magnetizability. Accordingly, much higher magnetizability of the high coercive force type permanent magnet has not been pursued to date. However, as a result of various studies by the present inventors, it has been confirmed that a high coercive force type permanent magnet obtains unprecedented excellent magnetizability, when it contains a large amount of heavy rare earth elements, so as to control the mean grain size of a sintered body and the content of oxygen in the sintered body, and it also contains elements such as Nb.

The second permanent magnet of the present invention can realize high magnetizability such that when Pc is 0.5, a magnetization rate c is 40% or more and a magnetization rate d is 70% or more, and when Pc is 1, the magnetization rate c is 55% or more and the magnetization rate d is 80% or more.

This permanent magnet can be assured to have properties with a residual flux density (Br) of 1.20 T or more, a maximum energy product ((BH) max) of 240 kJ/$m^3$ or more, and a squareness (Hk/HcJ) of 90% or more.

In order that the second permanent magnet of the present invention obtains the above excellent magnetizability, it is important that the amount of oxygen is 2,000 ppm or less, and more preferably 1,500 ppm or less in a sintered body, and that the mean grain size of the sintered body is between 3.5 and 5.0 μm. Moreover, in order to obtain the above excellent magnetizability, it is also important that Nb and/or Zr are dispersed in the sintered body.

The second permanent magnet of the present invention is desirably applied to a permanent magnet comprising a sintered body with a composition comprising of 25% to 35% by weight of R, 0.5% to 4.5% by weight of B, 0.02% to 0.5% by weight of Al and/or Cu, 0.2% to 1.5% by weight of Nb and/or 0.03% to 0.25% by weight of Zr, 2% or less by weight (excluding 0) of Co, and the balance substantially being Fe.

Since the second permanent magnet of the present invention is directed towards a high coercive force type permanent magnet, it may comprise 4.0% to 12.0% by weight of Dy as R. In addition, it may also comprise 1.0% to 6.0% by weight of Tb as R. Dy and Tb are elements effective to obtain a high coercive force. Needless to say, Dy and Tb can be contained in the permanent magnet, either singly or in combination. Thus, the second permanent magnet can have an intrinsic coercive force (HcJ) of 1,680 kA/m (21 kOe) or more.

Where Nb is contained in the permanent magnet of the present invention, the Nb is dispersed in the main phase ($R_2T_{14}B$ phase) and the grain boundary phase of a sintered body. Where Zr is contained in the permanent magnet of the present invention, the Zr is dispersed in the grain boundary phase of a sintered body.

Both the first and second permanent magnets of the present invention can be applied to various forms of magnets. In particular, when these permanent magnets are applied to multipolar magnets, they can remarkably exhibit their effects.

One or more elements selected from a group consisting of Ti, V, Cr, Mn, Bi, Nb, Ta, Mo, W, Sb, Ge, Sn, Ni, Si, Hf and Ga may be added to both the first and second permanent magnets of the present invention for purposes such as improvement of a coercive force or temperature stabilities, improvement of productivity, or cost reduction. Of these, Ga is effective to improve magnetizability, and it is added to the permanent magnets within a range preferably between 0.02% and 1.5% by weight, and more preferably between 0.1% and 1% by weight, with respect to the total weight.

Moreover, in order to have high magnetic properties, it is desirable to control the amount of nitrogen contained in a sintered body to 20 to 600 ppm and to control the amount of carbon contained therein to 1,500 ppm or lower.

In addition, the present invention provides an R-T-B system rare earth permanent magnet, which comprises a sintered body with a composition consisting essentially of 25% to 35% by weight of R (wherein R represents one or more rare earth elements (providing that the rare earth elements include Y)), 0.5% to 4.5% by weight of B, 0.02% to 0.5% by weight of Al and/or Cu, 0.03% to 0.25% by weight of Zr, 2% or less (excluding 0) by weight of Co, and the balance substantially being Fe, wherein the amount of oxygen is 2,000 ppm or less in the sintered body, and a mean grain size is between 3.3 and 4.3 μm in the sintered body.

Moreover, the present invention provides an R-T-B system rare earth permanent magnet, which comprises a sintered body with a composition consisting essentially of 25% to 35% by weight of R (wherein R represents one or more rare earth elements), 0.5% to 4.5% by weight of B, 0.02% to 0.5% by weight of Al and/or Cu, 0.2% to 1.5% by weight of Nb and/or 0.03% to 0.25% by weight of Zr, 2% or less (excluding 0) by weight of Co, and the balance substantially being Fe, wherein the amount of oxygen is 2,000 ppm or less in the sintered body, and a mean grain size is between 3.5 and 5.0 μm in the sintered body.

Furthermore, the present invention provides a multipolar magnet having multiple N and S polarities, which comprises a sintered body with a composition consisting essentially of 25% to 35% by weight of R (wherein R represents one or more rare earth elements (providing that the rare earth elements include Y)), 0.5% to 4.5% by weight of B, 0.02% to 0.5% by weight of Al and/or Cu, 0.03% to 0.25% by weight of Zr, 2% or less (excluding 0) by weight of Co, and the balance substantially being Fe, wherein 0.1% to 4.0% by weight of Dy is contained as the R, and when Pc is 2, if a total flux is defined as f1 under the application of an effective magnetic field of 240 kA/m, if a total flux is defined as f2 under the application of an effective magnetic field of 800 kA/m, and if a total flux is defined as f3 under the application of an effective magnetic field of 2,000 kA/m, a magnetization rate a (=f1/f3×100) is 40% or more, and a magnetization rate b (=f2/f3×100) is 90% or more.

In addition, the present invention provides a multipolar magnet having multiple N and S polarities, which comprises a sintered body with a composition consisting essentially of 25% to 35% by weight of R (wherein R represents one or more rare earth elements), 0.5% to 4.5% by weight of B, 0.02% to 0.5% by weight of Al and/or Cu, 0.2% to 1.5% by weight of Nb and/or 0.03% to 0.25% by weight of Zr, 2% or less (excluding 0) by weight of Co, and the balance substantially being Fe, wherein 4.0% to 12.0% by weight of Dy and/or 1.0% to 6.0% by weight of Tb are contained as the R, and when Pc is 2, if a total flux is defined as F1 under the application of an effective magnetic field of 240 kA/m, if a total flux is defined as F2 under the application of an effective magnetic field of 400 kA/m, and if a total flux is defined as F3 under the application of an effective magnetic field of 2,000 kA/m, a magnetization rate c (=F1/F3×100) is 60% or more, and a magnetization rate d (=F2/F3×100) is 85% or more.

BRIEF DESCRIPTION OF THE DRAWINGS

FIG. 1 is a table showing the composition of master alloys used in Experiment example 1 and the composition of a sintered body obtained in Experiment example 1;

FIG. 2 is a table showing magnetic properties of permanent magnets (samples 1 to 5) obtained in Experiment example 1;

FIG. 3 is a table showing the results obtained by measuring the magnetization rates (Pc=2) of samples 1 to 5;

FIG. 5 is a table showing the values of magnetizing fields necessary for samples 1 to 5 to obtain a magnetization rate of each of 40% , 50% , 60% , 70% , 80% , 90% and 95% ;

FIG. 6 is a table showing the composition of master alloys used in Experiment example 2 and the composition of a sintered body obtained in Experiment example 2;

FIG. 7 is a table showing magnetic properties of permanent magnets (samples 6 to 8) obtained in Experiment example 2;

FIG. 8 is a table showing the results obtained by measuring the magnetization rates (Pc=2) of samples 6 to 8;

FIG. 10 is a table showing the composition of master alloys used in Experiment example 3 and the composition of sintered bodies obtained in Experiment example 3;

FIG. 11 is a table showing magnetic properties of permanent magnets (samples 9 to 11) obtained in Experiment example 3;

FIG. 12 is a table showing the results obtained by measuring the magnetization rates (Pc=2) of samples 9 to 11;

FIG. 14 is a table showing the composition of master alloys used in Experiment example 4 and the composition of sintered bodies obtained in Experiment example 4;

FIG. 15 is a table showing magnetic properties of permanent magnets (samples 12 to 14) obtained in Experiment example 4;

FIG. 16 is a table showing the results obtained by measuring the magnetization rates (Pc=2) of samples 12 to 14;

FIG. 20 is a table showing magnetic properties of a permanent magnet (sample 15) obtained in Experiment example 5;

FIG. 21 is a table showing the results obtained by measuring the magnetization rates of sample 15 (Pc=2.0), sample 16 (Pc=1.0) and sample 17 (Pc=0.5);

FIG. 23 is a table showing the composition of an alloy used to obtain permanent magnets (samples 18 to 23) in Experiment example 6;

FIG. 24 is a table showing magnetic properties of samples 18 to 23;

FIG. 25 is a table showing the results obtained by measuring the magnetization rates (Pc=2) of samples 18 to 23;

FIG. 26 is a table showing the composition of an alloy used to obtain permanent magnets (samples 24 to 28) in Experiment example 7;

FIG. 27 is a table showing magnetic properties of samples 24 to 28;

FIG. 28 is a table showing the results obtained by measuring the magnetization rates (Pc=2) of samples 24 to 28;

FIG. 29 is a table showing the composition of alloys used to obtain permanent magnets (samples 29 to 36) in Experiment example 8;

FIG. 30 is a table showing magnetic properties of samples 18 and 29 to 36;

FIG. 31 is a table showing the results obtained by measuring the magnetization rates (Pc=2) of samples 18 and 29 to 36;

FIG. 32 is a table showing the composition of alloys used to obtain permanent magnets (samples 37 to 40) in Experiment example 9;

FIG. 33 is a table showing magnetic properties of samples 37 to 40;

FIG. 34 is a table showing the results obtained by measuring the magnetization rates (Pc=2) of samples 37 to 40;

FIG. 36 is a table showing the composition of alloys used to obtain permanent magnets (samples 41 to 44) in Experiment example 10;

FIG. 37 is a table showing magnetic properties of samples 41 to 44;

FIG. 38 is a table showing the results obtained by measuring the magnetization rates (Pc=2) of samples 41 to 44; and FIG. 39 is a table showing the results obtained by measuring the magnetization rates (Pc=2) of samples 19, 45 and 46.

DETAILED DESCRIPTION OF THE PREFERRED EMBODIMENTS

The permanent magnets of the present invention and a method for manufacturing them will be described below.

As is well known, a permanent magnet obtained by the present invention comprises at least a main phase consisting of $R_2T_{14}B$ crystal grains (wherein R represents one or more rare earth elements (providing that the rare earth elements include Y) and T represents one or more transition metal elements essentially containing Fe, or Fe and Co) and a grain boundary phase comprising a higher amount of R than the main phase.

<Magnetizability>

First, magnetizability of the permanent magnet of the present invention will be explained.

The above described first permanent magnet of the present invention that is a low coercive force type has a magnetization rate a (=f1/f3×100) of 40% or more and a magnetization rate b (=f2/f3×100) of 90% or more.

The f1 is used herein to mean a total flux under the application of an effective magnetic field of 240 kA/m, on condition that Pc is 2. The f2 is used herein to mean a total flux under the application of an effective magnetic field of 800 kA/m. The f3 is used herein to mean a total flux under the application of an effective magnetic field of 2,000 kA/m.

Figure 4:
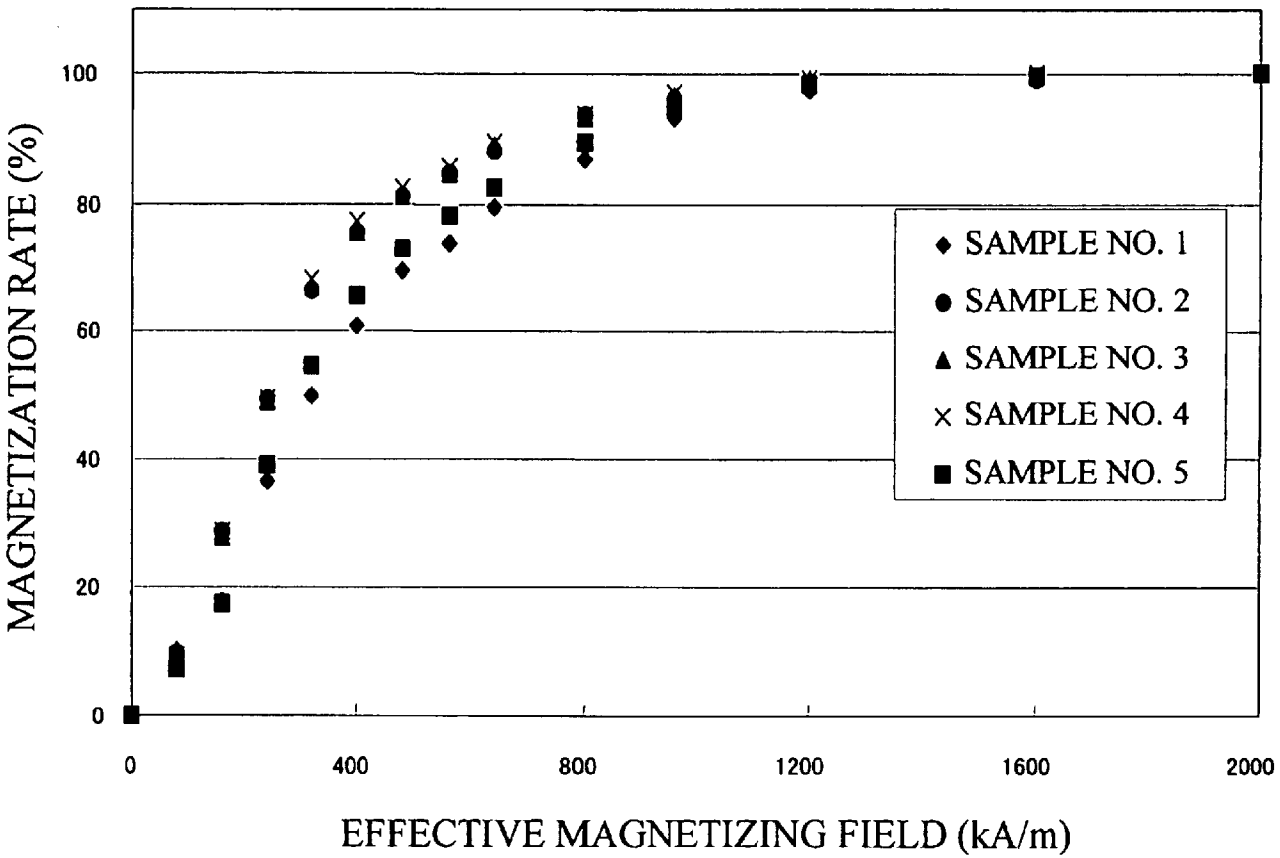
FIG. 4 is a graph showing the relationship between the magnetizing field and the magnetization rate (magnetization characteristic curve) of samples 1 to 5.

It is noted that in the present invention, Pc is defined based on FIGS. 5–4 on page 146 of "Kidorui Eikyu Jishaku (Rare earth permanent magnets), " Yoshio Tawara & Ken Ohashi, Morikita Shuppan Co., Ltd. In addition, a magnetization rate was measured as follows. A magnet to be evaluated was sandwiched between pole pieces to form a closed magnetic circuit. Thereafter, electric current was applied to the electromagnet so as to magnetize it. In this case, an applied magnetic field is equal to an effective magnetic field. After completion of the magnetization, the total flux was measured with a flux meter.

With regard to magnetizability, as stated above, it would be ideal if a high magnetization rate was obtained in a low magnetic field and if the magnetization characteristic curve existed on the low magnetic field side. However, it has previously not been easy to satisfy both the conditions. Thus, the present invention provides a permanent magnet having unprecedented magnetizability such as a magnetization rate a (=f1/f3×100) of 40% or more and a magnetization rate b (=f2/f3×100) of 90% or more. As described later in Examples, the permanent magnet of the present invention has an excellent magnetization rate even in a range between 240 kA/m and 800 kA/m.

In order to obtain the above described magnetizability, it is important that crystal grains in a sintered body have a mean grain size in a limited range between 3.3 and 4.3 μm. As explained later in the First example, if the mean grain size thereof is less than 3.3 μm or over 4.3 μm, the above magnetization rates a and b cannot be obtained.

On the other hand, the above described second permanent magnet of the present invention that is a high coercive force type has a magnetization rate c (=F1/F3×100) of 60% or more and a magnetization rate d (=F2/F3×100) of 85% or more.

The F1 is used herein to mean a total flux under the application of an effective magnetic field of 240 kA/m, on condition that Pc is 2. The F2 is used herein to mean a total flux under the application of an effective magnetic field of 400 kA/m. The F3 is used herein to mean a total flux under the application of an effective magnetic field of 2,000 kA/m.

If a total flux is defined as F4 under the application of an effective magnetic field of 800 kA/m, a magnetization rate e (=F4/F3×100) is 95% or more, and thus, an extremely high magnetization rate can be obtained. It is noted that the definition of Pc, a method of measuring a magnetization rate, and a method of measuring a total flux are the same as in the case of the first permanent magnet.

With regard to magnetizability, as stated above, it would be ideal if a high magnetization rate was obtained in a low magnetic field and if the rising edge of the magnetization rate was steep. However, it has previously not been easy to satisfy both the conditions. According to the second permanent magnet of the present invention that is a high coercive force type, however, an unprecedented permanent magnet can be obtained, which has a high magnetization rate in a low magnetic field, such as a magnetization rate c (=F1/F3×100) of 60% or more, a magnetization rate d (=F2/F3×100) of 85% or more and a magnetization rate e (F4/F3×100) of 95% or more, and which also has an early rising edge of the magnetization rate.

In order to obtain the above described magnetizability, it is important that each crystal grain in a sintered body has a mean grain size in a limited range between 3.5 and 5.0 μm. As explained later in the Second example, if the mean particle size of a crystal grain is less than 3.5 μm or over 5.0 μm, the above magnetization rates c and d cannot be obtained.

In both cases of adopting the low coercive force type permanent magnet and the high coercive force type permanent magnet, compositional factors to obtain the above described magnetizability may include regulation of the amount of oxygen contained in a sintered body and containment of Zr and/or Nb. This point will be described later in the section <Chemical composition>.

<Multipolar Magnet>

As stated above, the present invention is desirably applied to a multipolar magnet.

Examples of such a multipolar magnet may include a radial anisotropic or polar anisotropic ring magnet used for a motor, a rectangular magnet used pick-up driving of devices such as CD or DVD, and a fan-shaped magnet used for VCM (Voice Coil Motor). These multipolar magnets have multiple N and S polarities.

When the permanent magnet of the present invention is applied to the above described multipolar magnets, it makes the width of a neutral zone narrow. Thus, the amount of total flux increases, and if the multipolar magnet is used for a motor for example, the properties of the motor can be improved. The term "neutral zone" is used herein to mean a region on a magnet, which is magnetized to neither the N nor S pole in a boundary where the polarities (N or S) are reversed, when the magnet is magnetized. In particular, in small-sized magnets or magnets with a large number of poles, the ratio of the neutral zone is increased. Accordingly, when the permanent magnet of the present invention is applied to a multipolar magnet, it makes the width of a neutral zone narrow. Thus, the properties of a motor for which the present magnet is used can be improved.

<Chemical Composition>

Next, a desired chemical composition of the R-T-B system rare earth permanent magnet of the present invention will be explained. The term "chemical composition" is used herein to mean the final composition obtained after sintering (the composition of a sintered body).

The rare earth permanent magnet of the present invention comprises 25% to 35% by weight of rare earth elements (R)

The term R is used herein to mean one or more rare earth elements selected from a group consisting of La, Ce, Pr, Nd, Sm, Eu, Gd, Tb, Dy, Ho, Er, Yb, Lu and Y. If the amount of R is less than 25% by weight, $R_2T_{14}B$ crystal grains as a main phase of the permanent magnet might be insufficiently generated. Accordingly, α-Fe or the like having soft magnetism appears, and the coercive force thereby significantly decreases.

On the other hand, if the amount of Rexceeds 35% by weight, the volume ratio of the $R_2T_{14}B$ phase as a main phase decreases, and the residual flux density also decreases. Moreover, if the amount of R exceeds 35% by weight, R reacts with oxygen easily, and the content of oxygen thereby increases. In accordance with the increase of the oxygen content, an R rich phase effective for the generation of the coercive force decreases, resulting in a reduction in the coercive force. Therefore, the amount of R is set between 25% and 35% by weight. The amount of R is preferably between 28% and 33% by weight, and more preferably between 29% and 32% by weight.

Since Nd is abundant as a source and relatively inexpensive, it is preferable to use Nd as a main component of rare earth elements. Moreover, Dy and Tb are effective to improve the coercive force. Accordingly, it is preferable to set Nd as a main component of rare earth elements, to select Nd and/or Dy, and set the total amount of Nd, and Dy and/or Tb between 25% and 35% by weight. In addition, the amount of Dy and Tb is preferably determined within the above range, depending on which is considered to be more important, a residual flux density or a coercive force. When a high residual flux density is required to be obtained, the amount of Dy is preferably set between 0.1% and 4.0% by weight. On the other hand, when a high coercive force is required to be obtained, it is preferable to set the amount of Dy between 4.0% and 12.0% by weight and to set the amount of Tb between 1.0% and 6.0% by weight. It is noted that Tb exhibits an effect to improve a coercive force higher than that of Dy, and that when these elements are contained in a magnet in the same amount, Tb exhibits approximately 2 times the effect of Dy to improve a coercive force.

As stated above, the first feature of the present invention is that even when the permanent magnet of the present invention is a low coercive force type, it has excellent magnetizability. Accordingly, when the amount of Dy is low, such as between 0.1% and 4.0% by weight, the present invention exhibits sufficient effects by the first feature. Dy is added to a permanent magnet at a ratio of 10% or less by weight with respect to the total weight of rare earth elements. In such a case, the coercive force (HcJ) is 1,680 kA/m or less, and more preferably 1,440 kA/m or less.

On the other hand, the second feature of the present invention is that the permanent magnet of the present invention has excellent magnetizability even when it is a high coercive force type. Accordingly, when Dy and/or Tb are within the above described range, the present invention exhibits sufficient effects by the second feature. In such a case, the coercive force (HcJ) exceeds 1,680 kA/m. It is preferably 1,750 kA/m or more, and more preferably 2,000 kA/m or more.

Moreover, the permanent magnet of the present invention comprises 0.5% to 4.5% by weight of boron (B). If the amount of B is less than 0.5% by weight, a high coercive force cannot be obtained. However, if the amount of B exceeds 4.5% by weight, the residual flux density is likely to decrease. Accordingly, the upper limit is set at 4.5% by weight. The amount of B is preferably between 0.5% and 1.5% by weight, and more preferably between 0.8% and 1.2% by weight.

The permanent magnet of the present invention may comprise Al and/or Cu within the range between 0.02% and 0.5% by weight. The containment of Al and/or Cu within the above range can impart a high coercive force and improved temperature stabilities to the obtained permanent magnet. When Al is added, the additive amount of Al is preferably between 0.03% and 0.3% by weight, and more preferably between 0.05% and 0.25% by weight. When Cu is added, the additive amount of Cu is preferably 0.15% or less by weight (excluding 0), and more preferably between 0.03% and 0.08% by weight.

It is important for the permanent magnet of the present invention to comprise 0.2% to 1.5% by weight of Nb and/or 0.03% to 0.25% by weight of Zr. Zr is effective to improve the magnetizability of the permanent magnet. Moreover, when the content of oxygen is reduced to improve the magnetic properties of the permanent magnet, Zr exerts the effect of inhibiting the abnormal grain growth in a sintering process and thereby makes the microstructure of the sintered body uniform and fine. Accordingly, when the amount of oxygen is low, Zr fully exerts its effect. The amount of Zr is preferably between 0.05% and 0.25% by weight, and more preferably between 0.1% and 0.2% by weight.

As in the case of Zr, the containment of Nb is also effective to improve the magnetizability of the permanent magnet. Furthermore, when the content of oxygen is reduced to improve the magnetic properties of the permanent magnet, Nb also exerts the effect of inhibiting the abnormal grain growth in a sintering process and thereby makes the microstructure of the sintered body uniform and fine. Accordingly, as with Zr, Nb also fully exerts its effect when the amount of oxygen is low. The amount of Nb is preferably between 0.5% and 1.3% by weight, and more preferably between 0.5% and 1.2% by weight.

The permanent magnet of the present invention contains 2,000 ppm or less oxygen. If it contains a large amount of oxygen, an oxide phase that is a non-magnetic component increases, thereby decreasing magnetic properties. Thus, in the present invention, the amount of oxygen contained in a sintered body is set at 2,000 ppm or less, preferably 1,500 ppm or less, and more preferably 1,000 ppm or less. However, when the amount of oxygen is simply decreased, an oxide phase having a grain growth inhibiting effect decreases. Resulting from this phenomenon, the abnormal grain growth easily occurrs in a process of obtaining full density increase during sintering. Thus, in the present invention, the permanent magnet is allowed to contain a certain amount of Nb and/or Zr, which exert the effect of inhibiting the abnormal grain growth as well as the effect of improving magnetizability.

The permanent magnet of the present invention contains Co in an amount of 2% or less by weight (excluding 0), preferably between 0.1% and 1.0% by weight, and more preferably between 0.3% and 0.7% by weight. Co has an effect to improve Curie temperature and the corrosion resistance of a grain boundary phase.

<Manufacturing Method>

Next, a preferred method for manufacturing the permanent magnet of the present invention will be explained.

In the present embodiment, the permanent magnet of the present invention is manufactured by what is called a mixing method, using an alloy (low R alloy) containing $R_2T_{14}B$ crystal grains as main components and another alloy (high R alloy) containing a higher amount of R than the low R alloy. However, needless to say, the permanent magnet of the present invention can also be manufactured using a single master alloy or plural master alloys more than two.

A raw material metal is first subjected to strip casting in a vacuum or inert gas atmosphere, or preferably an Ar atmosphere, so that a low R alloy and a high R alloy are obtained. The low R alloy may comprise Cu and Al, as well as rare earth elements, Fe, Co and B. The high R alloy may contain Cu and Al, as well as rare earth elements, Fe, Co and B. If Zr is added, it is preferably added to the low R alloy.

After preparing the low R alloy and the high R alloy, these master alloys are crushed separately or together. The crushing step includes a crushing process and a pulverizing process. First, each of the master alloys is crushed to a particle size of approximately several hundreds of μm. The crushing is preferably carried out in an inert gas atmosphere, using a stamp mill, a jaw crusher, a brown mill, etc. In order to improve crushability, it is effective to carry out crushing after the absorption of hydrogen.

After carrying out the crushing, the routine proceeds to a pulverizing process. In the pulverizing process, a jet mill is mainly used, and crushed powders with a particle size of approximately several hundreds of μm are crushed to a mean particle size between 2.5 and 6 μm, and more preferably 3 and 5 μm. The jet mill is a method comprising releasing a high-pressure inert gas (e.g., nitrogen gas) from a narrow nozzle so as to generate a high-speed gas flow, accelerating the crushed powders with the high-speed gas flow, and making crushed powders hit against each other, the target, or the wall of the container, so as to pulverize the powders.

Basically, a method of mixing of two types of alloys is not limited. However, when the low R alloy and the high R alloy are pulverized separately in the pulverizing process, the pulverized low R alloy powders are mixed with the pulverized high R alloy powders in a nitrogen atmosphere. The mixing ratio of the low R alloy powders and the high R alloy powders may be approximately between 80:20 and 97:3 at a weight ratio. Likewise, in a case where the low R alloy is crushed or pulverized together with the high R alloy also, the same above mixing ratio may be applied. When approximately 0.01% to 0.3% by weight of additive agents such as zinc stearate is added during the pulverizing process, fine powders which are well oriented, can be obtained during compacting process.

Subsequently, mixed powders comprising the low R alloy powders and the high R alloy powders are filled in a tooling equipped with electromagnets, and they are compacted in a magnet field, in a state where their crystallographic c axis is oriented by applying a magnetic field. This compacting may be carried out by applying a pressure of approximately 30 to 300 MPa (0.3 to 3.0 t/cm$^2$) in a magnetic field of 960 to 1,600 kA/m (12 to 20 kOe). Preferably, the compacting may be carried out by applying a pressure of approximately 70 to 150 MPa (0.7 to 1.5 t/cm$^2$) in a magnetic field of 960 to 1,360 kA/m (12 to 17 kOe). Moreover, other than the above described method of applying a pressure in a magnetic field, a method of applying pulse in a magnetic field may also be used.

After the mixed powders are compacted in the magnetic field, the compacted body is sintered in a vacuum or inert gas atmosphere. The sintering may be carried out at 1,000° C. to 1,100° C. for about 1 to 5 hours. However, the sintering temperature needs to be adjusted depending on various conditions such as a composition, a crushing or pulverizing method, the difference between particle size and particle size distribution.

Before the sintering process, a treatment to remove a agent for helping crushing, gas or the like contained in a compacted body may be performed.

After completion of the sintering, the obtained sintered body may be subjected to heat treatment. The heat treatment is important for the control of a coercive force. When the heat treatment is carried out in two steps, it is effective to retain the sintered body for a certain time at around 800° C. and around 600° C. When a heat treatment is carried out at around 800° C. after completion of the sintering, the coercive force increases. Accordingly, such a heat treatment at around 800° C. is particularly effective in the mixing method. Moreover, when a heat treatment is carried out at around 600° C., the coercive force significantly increases. Accordingly, when the heat treatment is carried out in a single step, it is appropriate to carry out it at around 600° C.

EXAMPLES

The present invention will be further described in the following specific examples. The first example relates to a low coercive force type permanent magnet, and the second example relates to a high coercive force type permanent magnet.

First Example

Experiment Example 1

Master alloys (a low R alloy and a high R alloy) with compositions shown in FIG. 1 were prepared by the strip casting method.

A hydrogen crushing treatment was carried out on each of the obtained master alloys, in which after hydrogen was absorbed at room temperature, dehydrogenation was carried out thereon at 600° C. for 1 hour in an Ar atmosphere.

In order to obtain high magnetic properties, the amount of oxygen contained in a sintered body was controlled to 1,000 ppm or less in Experiment example 1. On this account, the atmosphere was controlled at an oxygen concentration of 100 ppm or less throughout processes, from a hydrogen crushing treatment (recovery after a crushing process) to sintering (input into a sintering furnace) (this condition was also applied in the following Experiment examples 2 to 11).

Generally, two-step crushing is carried out, which includes rough crushing and pulverizing. However, the crushing was omitted in Experiment example 1 (this condition was also applied in the following Experiment examples 2 to 11).

The low R alloy and the high R alloy that had been subjected to a hydrogen crushing treatment were mixed at a ratio of 90:10. At the same time, 0.1% oleic amide was added to the mixture as an agent for helping crushing. Thereafter, the alloy powders were subjected to pulverizing using a jet mill, so as to obtain five types of fine powders, each having a mean particle size (D) of 3.82 μm, 4.00 μm, 4.15 μm, 4.29 μm and 4.64 μm. The particle size was measured with a particle size analyzer by laser diffraction (Mastersizer manufactured by Malvern Instruments). The final composition obtained by mixing the low R alloy and the high R alloy (the composition of a sintered body) is shown in FIG. 1.

The obtained fine powders were subjected to a compression compacting in a magnetic field of 1,320 kA/m (16.5 kOe), so as to obtain a compact. The density of the compact was 4.2 $Mg/m^3$.

The obtained compact was sintered at 1,060° C. for 4 hours in a vacuum atmosphere, followed by quenching. Thereafter, the obtained sintered body was subjected to a two-step heat treatment consisting of treatments of 900° C.×1 hour and 530° C.×2.5 hours (both in an Ar atmosphere).

The obtained permanent magnet was measured with a B-H tracer in terms of magnetic properties. At the same time, the density of the sintered body, the mean grain size, the content of oxygen, the content of nitrogen, and the content of carbon were measured. The results are shown in FIG. 2. In the figure, d represents the mean grain size of a sintered body, ρ represents the density of the sintered body, Br represents a residual flux density, HcJ represents an intrinsic coercive force, (BH) max represents a maximum energy product, and Hk/HcJ represents a squareness. It is noted that the squareness (Hk/HcJ) is an index of magnetic performances, and that it indicates square degrees in the second quadrant of a magnetic hysteresis loop. Moreover, Hk means an external magnetic field strength obtained when the flux density becomes 90% of the residual flux density in the second quadrant of a magnetic hysteresis loop. To determine the mean grain size of a sintered body, the polished face of the sintered body was observed with a polarizing microscope (BX60M manufactured by Olympus Corporation), and the results were evaluated with an image processor (IP-1000 manufactured by Asahi Kasei Corporation). The particle area was obtained from this evaluation, and the obtained value was converted into the corresponding circular diameter, which was then defined as a particle size.

As shown in FIG. 2, it is found that all the permanent magnets of samples 1 to 5 have a residual flux density of 1.4 T or more, a coercive force of 1,000 kA/m or more, and a high maximum energy product of approximately 400 $kJ/m^3$ or more. Moreover, it is also found that all the permanent magnets contain a low level of impurities, such as the amount of oxygen of 1,000 ppm or less, the amount of nitrogen of 500 ppm or less, and the amount of carbon of 1,000 ppm or less.

Subsequently, the permanent magnets of samples 1 to 5 were measured in terms of a magnetization rate (Pc=2). The results are shown in FIGS. 3 and 4. As shown in FIGS. 3 and 4, it is found that sample 1 with the smallest mean grain size (3.2 μm) and sample 5 with the greatest mean grain size (4.4 μm) have a low magnetization rate in a low magnetizing field.

FIG. 5 shows the values of magnetizing fields necessary for samples 1 to 5 to obtain a magnetization rate of each of 40% , 50% , 60% , 70% , 80% , 90% and 95% . As shown in the figure, each of samples 2 to 4 obtains a magnetization rate of 40% in a magnetizing field of 240 kA/m (3 kOe). In contrast, samples 1 and 5 need a magnetizing field of 320 kA/m (4 kOe) to obtain the same above magnetization rate. Likewise, samples 2 to 4 can obtain a magnetization rate of each of 50% , 60% , 70% , 80% , 90% and 95% in a magnetizing field that is lower than that of samples 1 and 5.

From these results, it is found that a magnetization rate of 40% or more can be obtained in a low magnetizing field such as 240 kA/m by setting the mean grain size of a sintered body to 3.3 to 4.3 μm, and preferably to 3.5 to 4.0 μm. It is also found that a magnetization rate of 90% can be obtained in a lower magnetizing field by setting the mean grain size of a sintered body to 3.3 to 4.3 μm. In other words, a high magnetization rate can be obtained in a low magnetizing field.

Experiment Example 2

Three types of permanent magnets (samples 6 to 8) were obtained in the same manner as in Experiment example 1 with the exceptions that the master alloys with the compositions shown in FIG. 6 were used and that the amount of oxygen contained in the final sintered body was fluctuated by controlling the amount of oxygen contained in crushing gas (nitrogen) during the preparation of fine powders. The magnetic properties of the obtained permanent magnets were measured in the same manner as in Experiment example 1. The results are shown in FIG. 7. It is noted that Ts in FIG. 7 represents a sintering temperature and other symbols have the same meanings as in FIG. 2.

As shown in FIG. 7, it is found that all the permanent magnets of samples 6 to 8 have a residual flux density of 1.4 T or more, a coercive force of approximately 1,000 kA/m, and a high maximum energy product of approximately 400 $kJ/m^3$.

Figure 9:
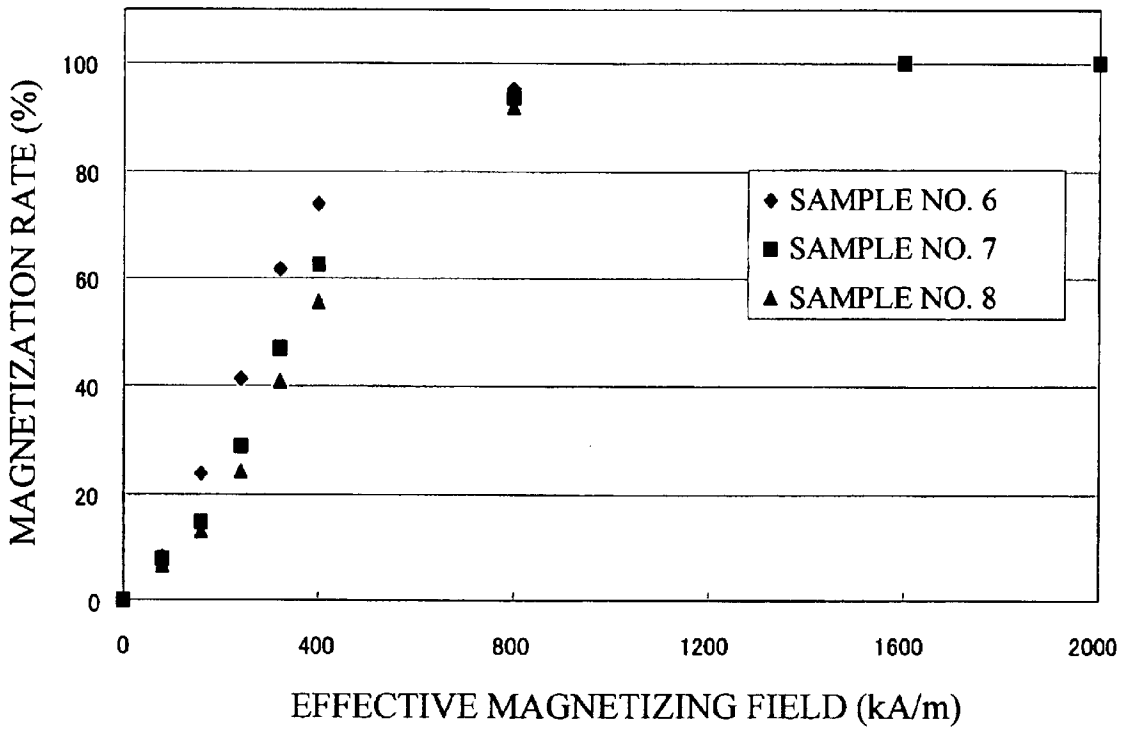
FIG. 9 is a graph showing the relationship between the magnetizing field and the magnetization rate (magnetization characteristic curve) of samples 6 to 8.

Subsequently, the permanent magnets of samples 6 to 8 were measured in terms of a magnetization rate (Pc=2). The results are shown in FIGS. 8 and 9. As shown in FIGS. 8 and 9, it is found that sample 6 with the lowest oxygen content of 580 ppm has a high magnetization rate in a low magnetizing field. This is to say, sample 6 can obtain a magnetization rate of 40% or more in a magnetizing field of 240 kA/m (3 kOe), a magnetization rate of 70% or more in a magnetizing field of 400 kA/m (5 kOe), and a magnetization rate of 95% or more in a magnetizing field of 800 kA/m (10 kOe). In contrast, sample 7 needs a magnetizing field of 400 kA/m (5 kOe) to obtain a magnetization rate of approximately 60% , and sample 8 obtains only a magnetization rate of 55% by applying a magnetizing field of 400 kA/m (5 kOe).

As described above, a magnetization rate is associated with the amount of oxygen contained in a permanent magnet. In order to improve a magnetization rate in magnetizing fields ranging from a low magnetizing field to a high magnetizing field, the amount of oxygen contained in a permanent magnet is set to 2,000 ppm or less, and more preferably to 1,000 ppm or less.

Experiment Example 3

Three types of permanent magnets (samples 9 to 11) were obtained in the same manner as in Experiment example 1 with the exception that the master alloys with the compositions shown in FIG. 10 were used. The magnetic properties of the obtained permanent magnets were measured in the same manner as in Experiment example 1. The results are shown in FIG. 11. It is noted that symbols used in FIG. 11 have the same meanings as in FIG. 7.

As shown in FIG. 11, sample 9 containing no element M has a low squareness such as 60.22% , and so this sample is not a practical permanent magnet. It is found that sample 10 containing Zr as the element M and sample 11 containing Ti as the element M have a residual flux density of 1.4 T or more, a coercive force of approximately 1,1100 kA/m, and a high maximum energy product of approximately 400 kJ/m$^3$.

The microstructure of sample 9 was observed. As a result, crystal grains that were abnormally grown to approximately 100 μm were observed in the sintered body. This is because the content of oxygen was low such as approximately 2,000 ppm and the amount of oxide controlling the grain growth was thereby reduced. It is assumed that the presence of these abnormal crystal grains causes a low squareness.

The microstructures of samples 10 and 11 were also observed. As a result, there were observed no abnormally grown crystal grains in these samples, which were observed in sample 9. It was confirmed that Zr was dispersed in the sintered body, more specifically in the grain boundary phase of sample 10, and that Ti was dispersed in the sintered body, more specifically in the grain boundary phase of sample 11. Thus, it is understood that Zr or Ti forms a certain compound and that this compound suppresses the abnormal grain growth.

Figure 13:
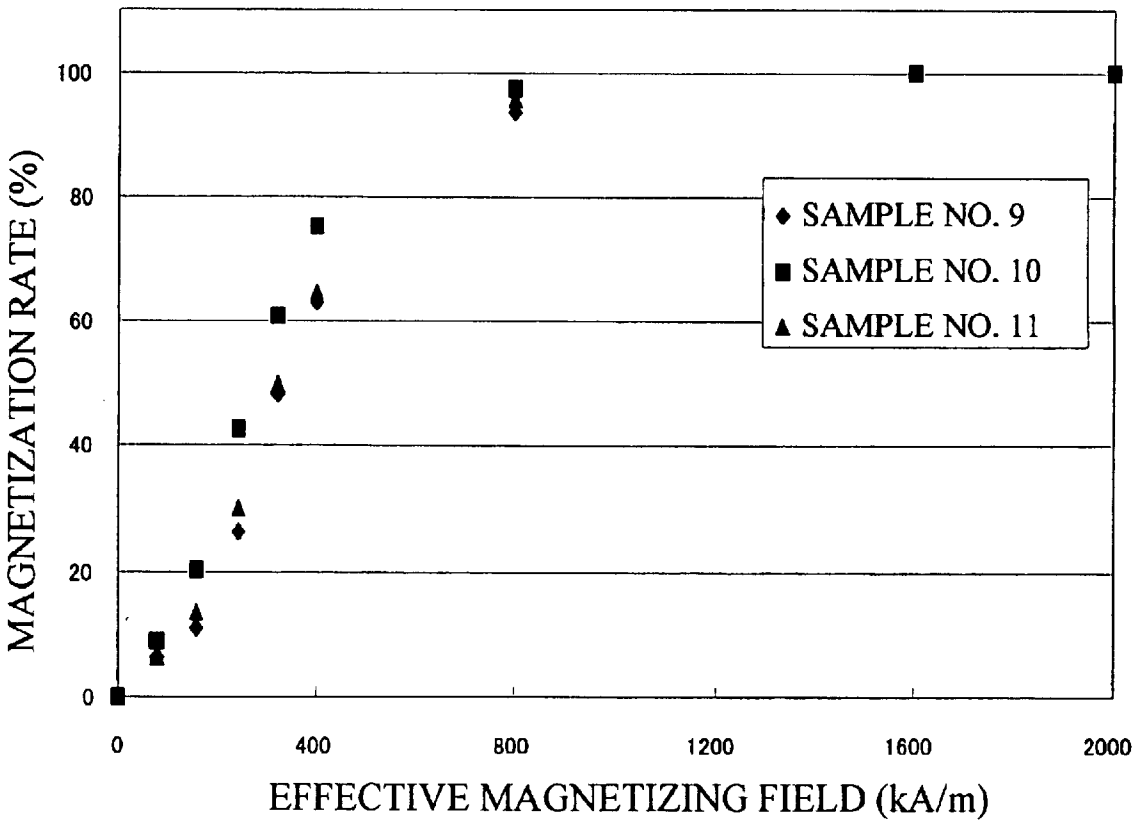
FIG. 13 is a graph showing the relationship between the magnetizing field and the magnetization rate (magnetization characteristic curve) of samples 9 to 11.

Subsequently, the permanent magnets of samples 9 to 11 were measured in terms of a magnetization rate (Pc=2). The results are shown in FIGS. 12 and 13. As shown in FIGS. 12 and 13, it is found that sample 10 containing Zr as the element M has a higher magnetization rate in a low magnetizing field, when it is compared with sample 9 containing no element M or with sample 11 containing Ti as the element M. This is to say, sample 10 can obtain a magnetization rate of more than 40% in a magnetizing field of 240 kA/m (3 kOe). In contrast, samples 9 and 11 can obtain only a magnetization rate of less than 30% .

As described above, it is found that both Zr and Ti are elements M, which control the abnormal grain growth and so these elements are effective to improve magnetic properties, and especially a squareness (Hk/HcJ), but that Zr is an effective element not only for improvement of magnetic properties, but also for improvement of magnetizability.

Experiment Example 4

Three types of permanent magnets (sample 12, sample 13 and sample 14) were obtained in the same manner as in Experiment example 1 with the exception that the master alloys shown in FIG. 14 were used. Samples 12 to 14 were measured in terms of magnetic properties and the mean grain size of a sintered body in the same manner as in Experiment example 1. The results are shown in FIG. 15.

Figure 17:
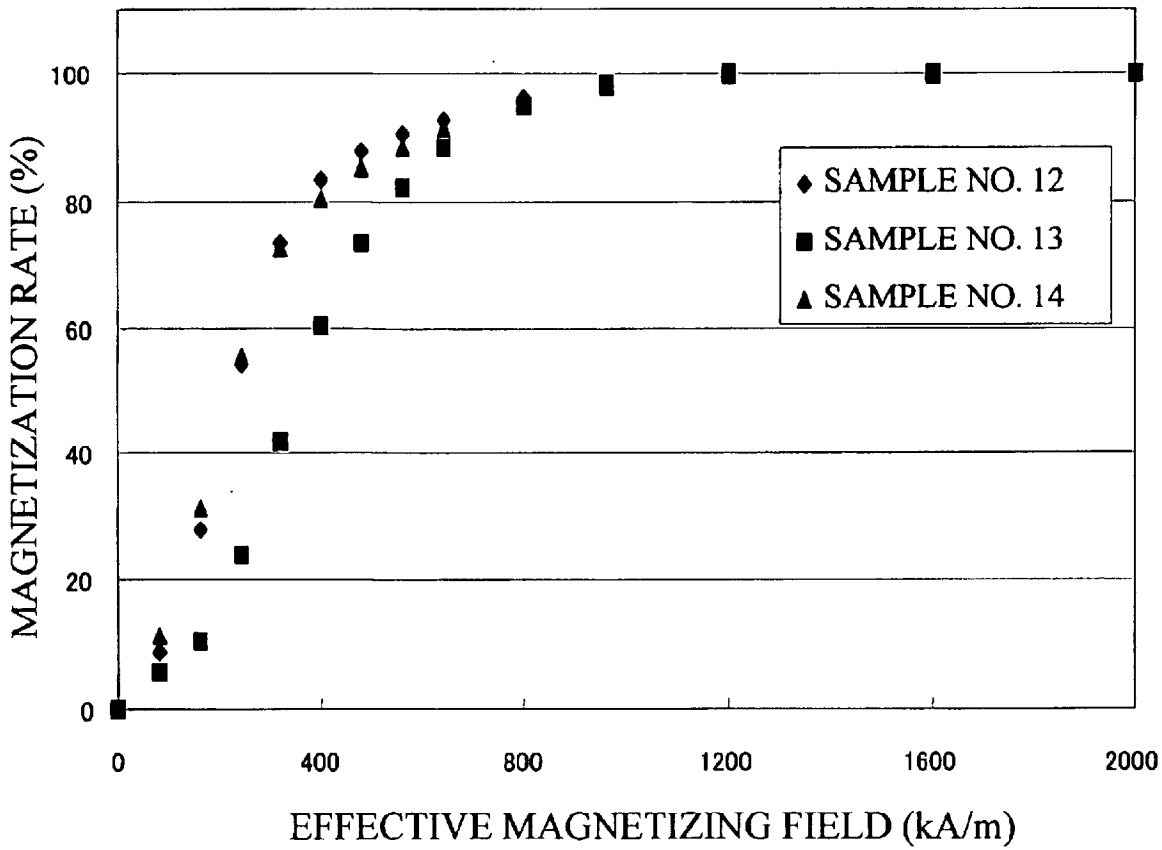
FIG. 17 is a graph showing the relationship between the magnetizing field and the magnetization rate (magnetization characteristic curve) of samples 12 to 14.

It is found from FIG. 15 that samples 12 and 13 have almost the same residual flux density (Br). Sample 14 contains a higher amount of Dy than samples 12 and 13, and accordingly it has a high coercive force (HcJ) such as 1,300 kA/m. Samples 12 to 14 were measured in terms of a magnetization rate (Pc=2) in the same manner as in Experiment example 1. The results are shown in FIGS. 16 and 17. As shown in FIGS. 16 and 17, sample 13, which contains no Zr but a high amount of oxygen, has only a magnetization rate of approximately 24% in a magnetizing field of 240 kA/m. In contrast, samples 12 and 14 containing Zr can obtain a magnetization rate of more than 50% in a magnetizing field of 240 kA/m.

Figure 18:
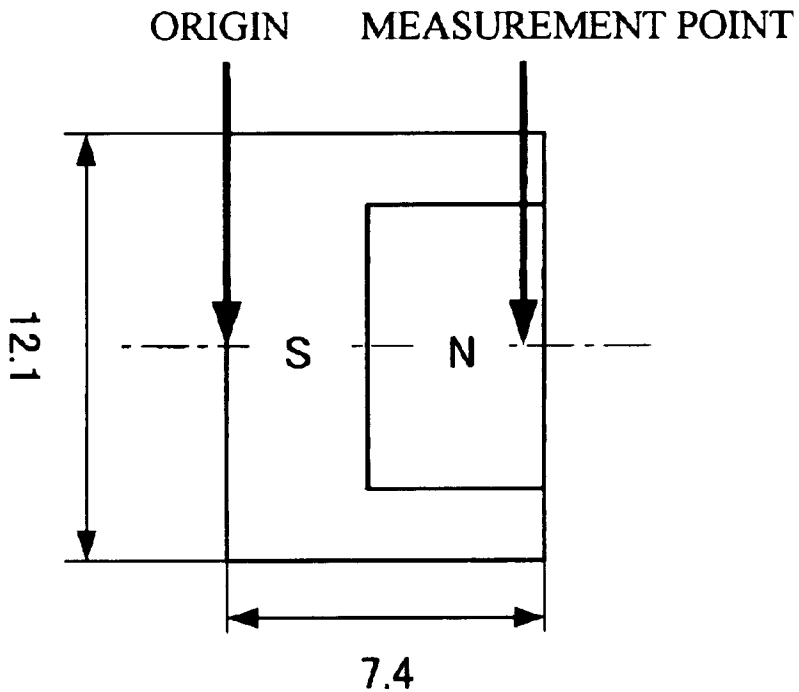
FIG. 18 is a plan view showing a form of test pieces prepared from samples 12 to 14, and showing a magnetizing pattern.

Thereafter, test pieces in the form shown in FIG. 18 (thickness: 2.1 mm) were prepared from samples 12 and 13, and magnetization was carried out in the form of a concave as shown in FIG. 18. The magnetization conditions are the following four conditions:

800 μF×500 V
800 μF×800 V
800 μF×1,100 V
800 μF×1,500 V

Figure 19:
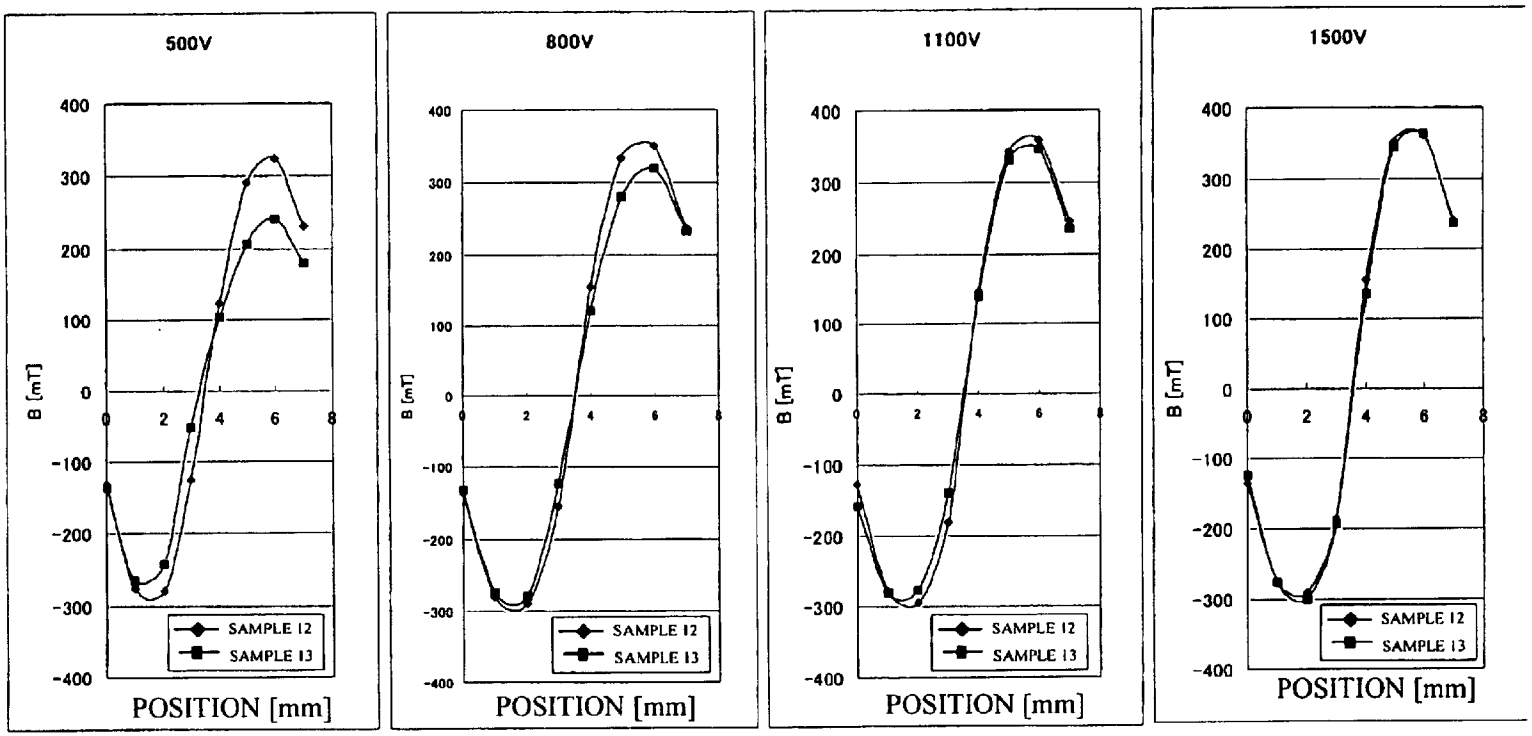
FIG. 19 is a set of graphs showing the relationship between the positions of the test pieces of FIG. 18 on a chain line and the total flux (B) with respect to each different magnetizing voltage.

Under each condition, a total flux was measured on a chain line as shown in FIG. 18. FIG. 19 is a set of graphs showing the relationship between the positions of the test pieces on a chain line and the total flux (B) with respect to each different magnetizing voltage.

When the magnetizing voltage is 1,500 V, which is in a state of nearly full magnetization, samples 12 and 13 show the same total flux (B). However, when the magnetizing voltage is 500 V, sample 12 shows 1.3 times or more the total flux (B) of sample 13. Similarly, when the magnetizing voltage is 800 V, sample 12 shows 1.1 times or more the total flux (B) of sample 13. When the magnetizing voltage is 500 V, the curve of sample 12 was compared with that of sample 13 around the position of 3.5 mm where the polarity should be inverted. As a result, the inclination of the latter (sample 13) was smaller than that of the former (sample 12), and this result suggests that the wider neutral zone exists.

From the above results, it is found that the use of sample 12 with excellent magnetizability can make the width of a neutral zone narrow. Accordingly, sample 12 with excellent magnetizability can impart excellent performance to actuators.

Experiment Example 5

Master alloys (a low R alloy and a high R alloy) with compositions shown in FIG. 1 were treated in the same manner as in Experiment example 1, so as to manufacture a permanent magnet (sample 15). The magnetic properties of the obtained permanent magnet were measured in the same manner as in Experiment example 1. The results are shown in FIG. 20.

Thereafter, from this permanent magnet, a sample with Pc=2.0 (sample 15), a sample with Pc=1.0 (sample 16), and a sample with Pc=0.5 (sample 17) were prepared, and their magnetization rates were then measured in the same manner as in Experiment example 1. The results are shown in FIGS. 21 and 22.

Figure 22:
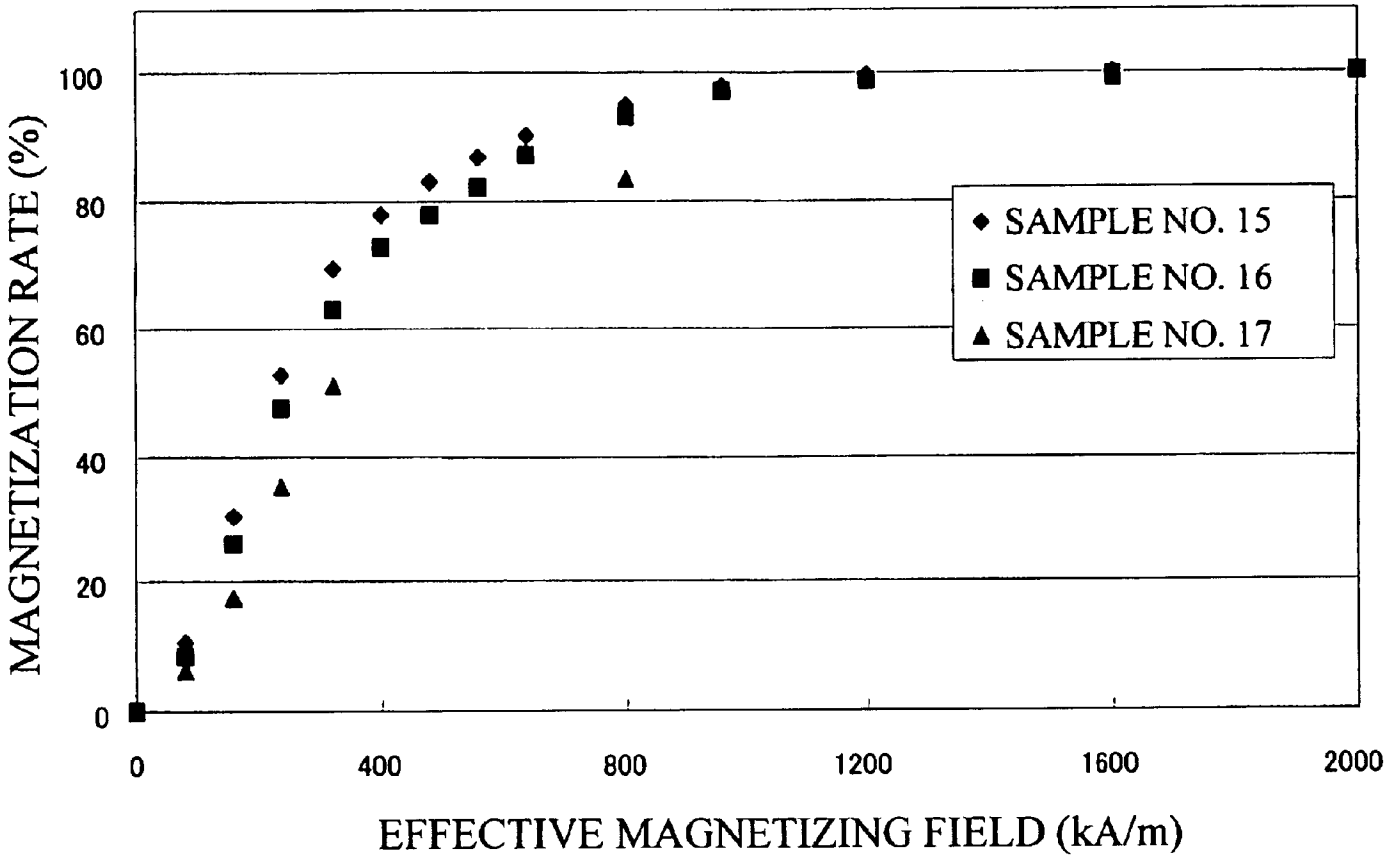
FIG. 22 is a graph showing the relationship between the magnetizing field and the magnetization rate (magnetization characteristic curve) of samples 15 to 17.

As shown in FIGS. 21 and 22, as Pc decreases, the magnetization rate also tends to decrease. In a magnetizing field of 240 kA/m, the magnetization rate is 35% or more, providing that Pc=1.0, and it is 30% or more, providing that Pc=0.5. Thus, it is found that a high magnetizing rate is obtained in a low magnetic field. Moreover, it is also found that in a magnetizing field of 800 kA/m, the magnetization rate is 90% or more, providing that Pc=1.0, and it is 80% or more, providing that Pc=0.5.

Second Example

Experiment Example 6

A master alloy with a composition shown in FIG. 23 was prepared by the strip casting method.

A hydrogen crushing treatment was carried out on the obtained master alloy under the same conditions as in Experiment example 1.

0.1% oleic amide was added as an agent for helping crushing to the alloy that had been subjected to a hydrogen crushing treatment. Thereafter, the alloy powders were subjected to pulverizing using a jet mill, so as to obtain six types of fine powders, each having a mean particle size (d) of 3.3 μm, 3.7 μm, 4.1 μm, 4.4 μm, 4.8 μm and 5.3 μm. The crushing was omitted as with Experiment example 1. The method of measuring the particle size is also the same as in Experiment example The obtained fine powders were subjected to a compression compacting in a magnetic field of 1,320 kA/m (16.5 kOe), so as to obtain a compact. The density of the compact was 4.2 $Mg/m^3$.

The obtained compact was sintered at 1,040° C. for 4 hours in a vacuum atmosphere, followed by quenching. Thereafter, the obtained sintered body was subjected to a two-step heat treatment consisting of treatments of 800° C.×1 hour and 530° C.×2.5 hours (both in an Ar atmosphere). The magnetic properties of the obtained permanent magnet were measured in the same manner as in Experiment example 1. The results are shown in FIG. 24.

As shown in FIG. 24, it is found that all the permanent magnets of samples 18 to 23 have a residual flux density of 1.3 T or more, a coercive force of 2,000 kA/m or more, a maximum energy product of approximately 340 $kJ/m^3$ or more, and a squareness (Hk/HcJ) of 90% or more. Moreover, it is also found that all the permanent magnets contain a low level of impurities, such as the amount of oxygen of 1,000 ppm or less, the amount of nitrogen of 500 ppm or less, and the amount of carbon of 1,000 ppm or less.

Subsequently, the permanent magnets of samples 18 to 23 were measured in terms of a magnetization rate (Pc=2). The results are shown in FIG. 25. As shown in FIG. 25, it is found that sample 18 with the smallest mean grain size (3.3 μm) and sample 23 with the greatest mean grain size (5.3 μm) have only a magnetization rate of less than 60% in a magnetizing field of 240 kA/m.

From these results, it can be confirmed that a magnetization rate of 60% or more can be obtained in a low magnetizing field of 240 kA/m by setting the mean grain size of a sintered body to 3.5 to 5.0 μm, and preferably to 4.0 to 4.5 μm. It is also found that a magnetization rate of 85% or more can be obtained in a low magnetizing field of 400 kA/m by setting the mean grain size of a sintered body to 3.5 to 5.0 μm. Moreover, as is clear from the fact that a magnetization rate of 95% or more can be obtained in a magnetizing field of 800 kA/m, the permanent magnet of the present invention shows an early rising edge of the magnetization rate.

Experiment Example 7

Five types of permanent magnets (samples 24 to 28) were obtained in the same manner as in Experiment example 6 with the exceptions that the master alloys with the compositions shown in FIG. 26 were used and that the amount of oxygen contained in the final sintered body was fluctuated by controlling the amount of oxygen contained in crushing gas (nitrogen) during the preparation of fine powders. The magnetic properties of the obtained permanent magnets were measured in the same manner as in Experiment example 1. The results are shown in FIG. 27.

As shown in FIG. 27, it is found that all the samples 24 to 28 have a residual flux density of 1.3 T or more, a coercive force of 2,300 kA/m or more, and a maximum energy product of approximately 330 $kJ/m^3$.

Subsequently, samples 24 to 28 were measured in terms of a magnetization rate (Pc=2). The results are shown in FIG. 28. As shown in FIG. 28, it is found that sample 24 with the lowest oxygen content of 490 ppm has a high magnetization rate in a low magnetizing field. Moreover, samples 24 to 27 can have a magnetization rate of 70% or more in a magnetizing field of 240 kA/m (3 kOe), a magnetization rate of 90% or more in a magnetizing field of 400 kA/m (5 kOe), and a magnetization rate of almost 100% in a magnetizing field of 800 kA/m (10 kOe). In contrast, sample 28 cannot obtain a magnetization rate of more than 60% in a magnetizing field of 240 kA/m (3 kOe). Likewise, the magnetization rate of sample 28 does not reach 85% in a magnetizing field of 400 kA/m (5 kOe).

As described above, a magnetization rate is associated with the amount of oxygen contained in a permanent magnet. In order to improve a magnetization rate in magnetizing fields ranging from a low magnetizing field to a high magnetizing field, the amount of oxygen contained in a permanent magnet is set to 2,000 ppm or less, preferably to 1,500 ppm or less, and more preferably to 1,000 ppm or less.

Experiment Example 8

Eight types of permanent magnets (samples 29 to 36) were obtained in the same manner as in Experiment example 1 with the exception that the master alloys with the compositions shown in FIG. 29 were used. The magnetic properties of the obtained permanent magnets were measured in the same manner as in Experiment example 1. The results are shown in FIG. 30. It is noted that sample 18 in Experiment example 6 is also shown in FIG. 30.

As shown in FIG. 30, sample 29 containing no element M has a squareness (Hk/HcJ) of 93.6% , which is lower than those of other samples. In contrast, samples 18 and 30 to 36 containing the element M have a squareness (Hk/HcJ) of more than 95% . It is found that, in particular, sample 30 containing Nb, sample 34 containing Ga, and sample 36 containing Zr and Nb have a high squareness (Hk/HcJ) and a high coercive force (HcJ).

The micro structure of sample 29 was observed. As a result, crystal grains that were abnormally grown to approximately 100 μm were observed in the sintered body. This is because the content of oxygen was low such as approximately 1,000 ppm and the amount of oxide controlling the grain growth was thereby reduced. It is assumed that the presence of these abnormal crystal grains causes a low squareness.

The microstructures of samples 18 and 30 to 36 were also observed. As a result, there were observed no abnormally grown crystal grains in these samples, which were observed in sample 29. It was confirmed that Nb was dispersed in the main phase and the grain boundary phase of samples 18 and 30 to 36, and that Zr was dispersed in the grain boundary phase of sample 31 and 36. Thus, it is understood that Nb or Zr forms a certain compound and that this compound suppresses the abnormal grain growth.

Subsequently, the permanent magnets of samples 18 and 29 to 36 were measured in terms of a magnetization rate (Pc=2). The results are shown in FIG. 31. It is noted that the results regarding sample 18 are also shown in FIG. 31. As shown in the figure, it is found that sample 29 containing no element M can obtain only a magnetization rate of less than 50% in a magnetizing field of 240 kA/m, but that samples 18 and 30 to 36 containing the element M can obtain a magnetization rate of more than 60% in a magnetizing field of 240 kA/m. Moreover, it is also found that sample 29 containing no element M can obtain only a magnetization rate of less than 85% in a magnetizing field of 400 kA/m, but that samples 18 and 30 to 36 containing the element M can obtain a magnetization rate of more than 85% in a magnetizing field of 400 kA/m.

As described above, it is found that the element M, which controls the abnormal grain growth, is effective to improve magnetic properties, especially a squareness (Hk/HcJ), and that it is also effective to improve magnetizability. In particular, Nb, Zr and Ga are elements effective to improve both magnetic properties and magnetizability greatly.

Experiment Example 9

Four types of permanent magnets (samples 37 to 40) were obtained in the same manner as in Experiment example 6 with the exception that the master alloys shown in FIG. 32 were used. Samples 37 to 40 were measured in terms of the magnetic properties and the mean grain size of a sintered body in the same manner as in Experiment example 6. The results are shown in FIG. 33.

It is found from FIGS. 32 and 33 that as the amount of Dy increases, a coercive force (HcJ) increases, on the other hand, a residual flux density (Br) decreases.

Samples 37 to 40 were measured in terms of a magnetization rate (Pc=2) in the same manner as in Experiment example 6. The results are shown in FIG. 34. As shown in FIG. 34, it is found that as the amount of Dy increases, a magnetization rate is improved. In particular, the difference is significant in a magnetizing field of 400 kA/m or less.

Moreover, test pieces in the form shown in FIG. 18 (thickness: 2.1 mm) were prepared from samples 37 and 40, and magnetization was carried out in the form of a concave as shown in FIG. 18. The magnetization conditions are the following four conditions:

800 μF×350 V
800 μF×600 V
800 μF×900 V
800 μF×1,500 V

Figure 35:
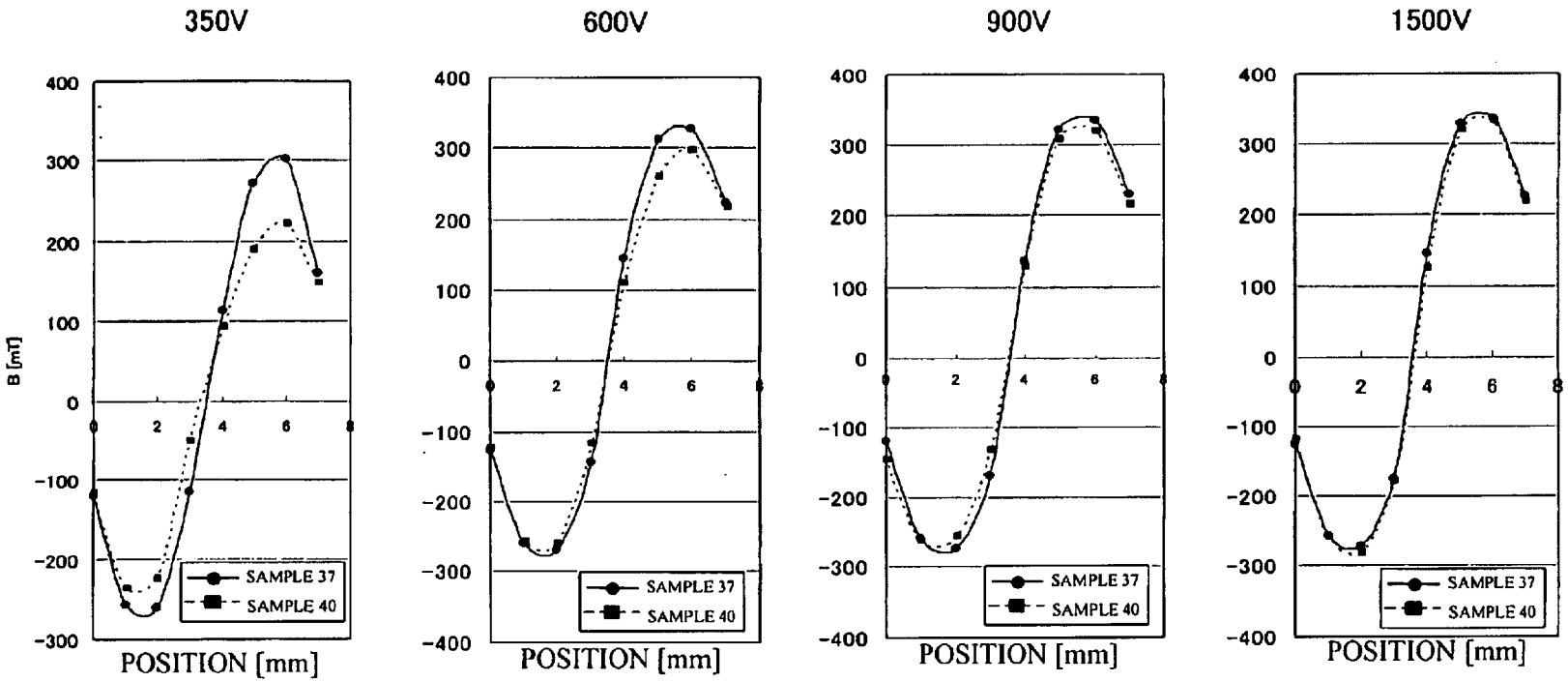
FIG. 35 is a set of graphs showing the relationship between the positions of the test pieces of FIG. 18 on a chain line and the total flux (B) with respect to each different magnetizing voltage.

Under each magnetization condition, a total flux was measured on a chain line as shown in FIG. 18. FIG. 35 is a set of graphs showing the relationship between the positions of the test pieces on a chain line and the total flux (B) with respect to each different magnetizing voltage.

When the magnetizing voltage is 1,500 V, which is in a state of nearly full magnetization, samples 37 and 40 show the same total flux (B). However, when the magnetizing voltage is 350 V, sample 37 shows 1.3 times or more the total flux (B) of sample 40. Similarly, when the magnetizing voltage is 600 V, sample 37 shows 1.1 times or more the total flux (B) of sample 40. When the magnetizing voltage is 350 V, the curve of sample 37 was compared with that of sample 40 around the position of 3.5 mm where the polarity should be inverted. As a result, the inclination of the former was smaller than that of the latter, and this result suggests that the wider neutral zone exists.

From the above results, it is found that the use of a sample with excellent magnetizability can make the width of a neutral zone narrow. Accordingly, such a sample with excellent magnetizability can impart excellent performance to actuators.

Experiment Example 10

Four types of permanent magnets (samples 41 to 44) were obtained in the same manner as in Experiment example 6 with the exception that the master alloys shown in FIG. 36 were used. Samples 41 to 44 were measured in terms of the magnetic properties and the mean grain size of a sintered body in the same manner as in Experiment example 6. The results are shown in FIG. 37.

It is found from FIGS. 36 and 37 that as the amount of Tb increases, an intrinsic coercive force (HcJ) increases, on the other hand, a residual flux density (Br) decreases.

Samples 41 to 44 were measured in terms of a magnetization rate (Pc=2) in the same manner as in Experiment example 6. The results are shown in FIG. 38.

As shown in FIG. 38, it is found that as the amount of Tb increases, a magnetization rate is improved. In particular, the difference is significant in a magnetizing field of 400 kA/m or less. Moreover, when compared with the case in Experiment example 9, it is found that Tb in a smaller amount can exhibit the same effects as those of Dy.

Experiment Example 11

From sample 19 in Experiment example 6, a sample with Pc=1.0 (sample 45) and a sample with Pc=0.5 (sample 46) were further prepared, and their magnetization rates were then measured in the same manner as in Experiment example 6. The results are shown in FIG. 39.

As shown in FIG. 39, as Pc decreases, the magnetization rate also tends to decrease. In a magnetizing field of 240 kA/m, the magnetization rate is more than 55% , providing that Pc=1.0, and it is more than 40% , providing that Pc=0.5. Thus, it is found that a high magnetizing rate is obtained in a low magnetic field. Moreover, it is also found that in a magnetizing field of 400 kA/m, the magnetization rate is more than 80% , providing that Pc=1.0, and it is more than 70% , providing that Pc=0.5.

According to the first technique of the present invention, a permanent magnet can be obtained, which has an improved magnetization rate in a low magnetizing field such as approximately 320 kA/m (4 kOe) and also has an improved magnetization rate in a high magnetizing field such as 800 kA/m (10 kOe).

According to the second technique of the present invention, a permanent magnet can be obtained, which has an improved magnetization rate in a low magnetizing field such as approximately 400 kA/m (5 kOe) and also has an improved magnetization rate in a high magnetizing field such as 800 kA/m (10 kOe).

When such a permanent magnet with excellent magnetizability is used for a multipolar magnet, it makes the width of a neutral zone narrow. A motor using such a ring magnet maintains high rotation performance.

Moreover, in many cases, inexpensive magnet with a high magnetization rate may actually produce a total flux larger than that of an expensive magnet with a low magnetization rate although it has high magnetic properties. Therefore, the present invention realizes a certain total flux using an inexpensive magnet. Moreover, it also downsizes a magnet.

What is claimed is:

1. An R-T-B system rare earth permanent magnet, which comprises a sintered body comprising:

an $R_2T_{14}B$ phase (wherein R represents one or more rare earth elements (providing that the rare earth elements include Y) and T represents one or more transition metal elements essentially containing Fe, or Fe and Co) as a main phase; and a grain boundary phase containing a higher amount of R than said main phase, wherein, when Pc (permeance coefficient) is 2, if a total flux is defined as f1 under the application of an effective magnetic field of 240 kA/m (providing that an effective magnetic field=an applied magnetic field−a demagnetizing field, and each value of them is absolute value), if a total flux is defined as f2 under the application of an effective magnetic field, of 800 kA/m, and if a total flux is defined as f3 under the application of an effective magnetic field of 2000 kA/m, a magnetization rate a (=f1/f3×100) is 40% or more, and a magnetization rate b (=f2/f3×100) is 90% or more.

2. An R-T-B system rare earth permanent magnet according to claim 1, which has a coercive force (HcJ) is 1,672 kA/m or less.

3. An R-T-B system rare earth permanent magnet according to claim 1, which has a residual flux density (Br) of 1.35 T or more, a maximum energy product ((BH) max) of 350 kJ/$m^3$ or moxe, and a squareness (Hk/HcJ) of 95% or more.

4. An R-T-B system rare earth permanent magnet according to claim 1, wherein a mean grain size is between 3.3 and 4.3 μm in said sintered body.

5. An R-T-B system rare earth permanent magnet according to claim 1, wherein the amount of oxygen is 1,500 ppm or less in said sintered body.

6. An R-T-B system rare earth permanent magnet according to claim 1, wherein Zr is dispersed in said sintered body.

7. An R-T-B system rare earth permanent magnet, which comprises a sintered body with a composition comprising of 25% to 35% by weight of R (wherein R represents one or more rare earth elements (providing that the rare earth elements include Y)), 0.5% to 4.5% by weight of B, 0.02% to 0.5% by weight of Al anchor Cu, 0.03% to 0.25% by weight of Zr, 2% or less (excluding 0) by weight of Co, and the balance substantially being Fe, wherein the amount of oxygen is 2,000 ppm or less in said sintered body, and a mean grain size is between 3.3 and 4.3 μm in said sintered body wherein the amount of nitrogen is 20 to 600 ppm and the amount of carbon is 1,500 ppm or less in said sintered body.

8. An R-T-B system rare earth permanent magnet according to claim 7, which comprises 0.1% to 4.0% by weight of Dy as R.

9. An R-T-B system rare earth permanent magnet according to claim 7, wherein Zr is dispersed in the grain boundary phase of said sintered body.

10. An R-T-B system rare earth permanent magnet according to claim 7, which is a multipolar magnet.

11. An R-T-B system rare earth permanent magnet, which comprises a sintered body comprising:

an $R_2T_{14}B$ phase (wherein R represents one or more rare earth elements (providing that the rare earth elements include Y) and T represents one or more transition metal elements essentially comprising Fe, or Fe and Co) as a main phase; and a grain boundary phase containing a higher amount of R than said main phase, wherein, when Pc (permeance coefficient) is 2, if a total flux is defined as F1 under the application of an effective magnetic field of 240 kA/m (providing that an effective magnetic field=an applied magnetic field−a demagnetizing field, and each value of them is absolute value), if a total flux is defined as F2 under the application of an effective magnetic field of 400 kA/m, and if a total flux is defined as F3 under the application of an effective magnetic field of 2,000 kA/m, a magnetization rate c (=F1/F3×100) is 60% or more, and a magnetization rate d (=F2/F3×100) is 85% or more.

12. An R-T-B system rare earth permanent magnet according to claim 11, which has a coercive force (HcJ) of more than 1,680 kA/m.

13. An R-T-B system rare earth permanent magnet according to claim 11, which has a residual flux density (Br) of 1.20 T or more, a maximum energy product ((BH) max) of 240 kJ/$m^3$ or more, and a squareness (Hk/HcJ) of 90% or more.

14. An R-T-B system rare earth permanent magnet according to claim 11, wherein a mean grain size is between 3.5 and 5.0 μm in said sintered body.

15. An R-T-B system rare earth permanent magnet according to claim 11, wherein the amount of oxygen is 1,500 ppm or less in said sintered body.

16. An R-T-B system rare earth permanent magnet according to claim 11, wherein Nb is dispersed in said sintered body.

17. A multipolar magnet having multiple N and S polarities, which comprises a sintered body with a composition comprising of 25% to 35% by weight of R (wherein R represents one or more rare earth elements (providing that the rare earth elements include Y)), 0.5% to 4.5% by weight of B, 0.02% to 0.5% by weight of Al and/or Cu, 0.03% to 0.2 5% by weight of Zr, 2% or less (excluding 0) by weight of Go, and the balance substantially being Fe, wherein 0.1% to 4.0% by weight of Dy is comprised as said R, and when Pc (permeance coefficient) is 2, if a total flux is defined as f1 under the application of an effective magnetic field of 240 kA/m (providing that an effective magnetic field=an applied magnetic field−a demagnetizing field, and each value of them is absolute value), if a total flux is defined as f2 under the application of an effective magnetic field of 800 kA/m, and if a total flux is defined as f3 under the application of an effective magnetic field of 2,000 kA/m, a magnetization rate a (=f1/f3×100) is 40% or more, and a magnetization rate b (=f2/f3×100) is 90% or more.

18. A multipolar magnet having multiple N and S polarities, which comprises a sintered body with a composition comprising of 25% to 35% by weight of R (wherein R represents one or more rare earth elements), 0.5% to 4.5% by weight of B, 0.02% to 0.5% by weight of Al and/or Cu, 0.2% to 1.5% by weight of Nb and/or 0.03% to 0.25% by weight of Zr, 2% or less (excluding 0) by weight of Co, and the balance substantially being Fe, wherein 4.0% to 12.0% by weight of Dy and/or 1.0% to 6.0% by weight of Tb are comprised as said R, and when Pc (permeance coefficient) is 2, if a total flux is defined as F1 under the application of an effective magnetic field of 240 kA/m (providing that an effective magnetic field=an applied magnetic field−a demagnetizing field, and each value of them is absolute value), if a total flux is defined as F2 under the application of an effective magnetic field of 400 kA/m, and if a total flux is defined as F3 under the application of an effective magnetic field of 2,000 kA/m, a magnetization rate c (=F1/F3×100) is 60% or more, and a magnetization rate d (=F2/F3×100) is 85% or more.

19. An R-T-B system rare earth permanent magnet, which comprises a sintered body with a composition consisting essentially of 25% to 35% by weight of R (wherein R represents one or more rare earth elements (providing that the rare earth elements include Y)), 0.5% to 4.5% by weight of B, 0.02% to 0.5% by weight of Al and/or Cu, 0.03% to 0.25% by weight of Zr, 2% or less (excluding 0) by weight of Co, and the balance substantially being Fe, wherein the amount of oxygen is 2,000 ppm or less in said sintered body, and a mean grain size is between 3.3 and 4.3 μm in said sintered body wherein the amount of nitrogen is 20 to 600 ppm and the amount of carbon is 1,500 ppm or less in said sintered body.

20. An R-T-B system rare earth permanent magnet, which comprises a sintered body with a composition consisting essentially of 25% to 35% by weight of R (wherein R represents one or more rare earth elements), 0.5% to 4.5% by weight of B, 0.02% to 0.5% by weight of Al and/or Cu, 0.03% to 0.25% by weight of Zr, 2% or less (excluding 0) by weight of Co, and the balance substantially being Fe, wherein the amount of oxygen is 2,000 ppm or less in said sintered body, and a mean grain size is between 3.5 and 5.0 μm in said sintered body wherein the amount of nitrogen is 20 to 600 ppm and the amount of carbon is 1,500 ppm or less in said sintered body.

21. A multipolar magnet having multiple N and S polarities, which comprises a sintered body with a composition consisting essentially of 25% to 35% by weight of R (wherein R represents one or more rare earth elements (providing that the rare earth elements include Y)), 0.5% to 4.5% by weight of B, 0.02% to 0.5% by weight of Al and/or Cu, 0.03% to 0.25% by weight of Zr, 2% or less (excluding 0) by weight of Co, and the balance substantially being Fe, wherein 0.1% to 4.0% by weight of Dy is contained as said R, and when Pc (permeance coefficient) is 2, if a total flux is defined as f1 under the application of an effective magnetic field of 240 kA/m (providing that an effective magnetic field=an applied magnetic field−a demagnetizing field, and each value of them is absolute value), if a total flux is defined as f2 under the application of an effective magnetic field of 800 kA/m, and if a total flux is defined as f3 under the application of an effective magnetic field of 2,000 kA/m, a magnetization rate a (=f1/f3×100) is 40% or more, and a magnetization rate b (=f2/f3×100) is 90% or more.

22. A multipolar magnet having multiple N and S polarities, which comprises a sintered body with a composition consisting essentially of 25% to 35% by weight of R (wherein R represents one or more rare earth elements), 0.5% to 4.5% by weight of B, 0.02% to 0.5% by weight of Al and/or Cu, 0.2% to 1.5% by weight of Nb and/or 0.03% to 0.25% by weight of Zr, 2% or less (excluding 0) by weight of Co, and the balance substantially being Fe, wherein 4.0% to 12.0% by weight of Dy and/or 1.0% to 6.0% by weight of Tb are contained as said R, and when Pc (permeance coefficient) is 2, if a total flux is defined as F1 under the application of an effective magnetic field of 240 kA/m (providing that an effective magnetic field=an applied magnetic field−a demagnetizing field, and each value of them is absolute value), if a total flux is defined as F2 under the application of an effective magnetic field of 400 kA/m, and if a total flux is defined as F3 under the application of an effective magnetic field of 2,000 kA/m, a magnetization rate c (=F1/F3×100) is 60% or more, and a magnetization rate d (=F2/F3×100) is 85% or more.

23. An R-T-B system rare earth permanent magnet, which comprises a sintered body with a composition comprising of 25% to 35% by weight of R (wherein R represents one or more rare earth elements), 0.5% to 4.5% by weight of B, 0.02% to 0.5% by weight of Al and/or Cu, 0.2% to 1.5% by weight of Nb, 2% or less (excluding 0) by weight of Co, and the balance substantially being Fe, wherein the amount of oxygen is 2,000 ppm or less in said sintered body, a mean grain size is between 3.5 and 5.0 μm in said sintered body, Nb is dispersed in the main phase and the grain boundary phase of said sintered body.

24. An R-T-B system rare earth permanent magnet, which comprises a sintered body comprising:

an $R_2T_{14}B$ phase (wherein R represents one or more rare earth elements (providing that the rare earth elements include Y) and T represents one or more transition metal elements essentially comprising Fe, or Fe and Co) as a main phase; and a grain boundary phase containing a higher amount of R than said main phase, wherein:

said sintered body has a composition comprising of 25% to 35% by weight of R, 0.5% to 4.5% by weight of B, 0.02% to 0.5% by weight of Al and/or Cu, 0.03% to 0.25% by weight of Zr, 2% or less (excluding 0) by weight of Co, and the balance substantially being Fe, the amount of oxygen is 2,000 ppm or less in said sintered body, and a mean grain size is between 3.5 and 5.0 μm in said sintered body and when Pc (permeance coefficient) is 2, if a total flux is defined as F1 under the application of an effective magnetic field of 240 kA/m (providing that an effective magnetic field=an applied magnetic field−a demagnetizing field, and each value of them is absolute value), if a total flux is defined as F2 under the application of an effective magnetic field of 400 kA/m, and if a total flux is defined as F3 under the application of an effective magnetic field of 2,000 kA/m, a magnetization rate c (=F1/F3×100) is 60% or more, and a magnetization rate d (=F2/F3×100) is 85% or more.

25. An R-T-B system rare earth permanent magnet according to claim 24, which comprises 4.0% to 12.0% by weight of Dy and/or 1.0% to 6.0% by weight of Tb as R.

26. An R-T-B system rare earth permanent magnet according to claim 24, wherein Zr is dispersed in the grain boundary phase of said sintered body.

27. An R-T-B system rare earth permanent magnet according to claim 24, which is a multipolar magnet.

28. An R-T-B system rare earth permanent magnet according to claim 24, wherein the amount of nitrogen is 20 to 600 ppm and the amount of carbon is 1,500 ppm or less in said sintered body.

29. An R-T-B system rare earth permanent magnet according to claim 24, which comprises 0.02% to 1.5% by weight of Ga.

30. An R-T-B system rare earth permanent magnet according to claim 24, which comprises 0.2% to 1.5% by weight of Nb.

31. An R-T-B system rare earth permanent magnet according to claim 30, wherein Nb is dispersed in the main phase and the grain boundary phase of said sintered body.

32. An R-T-B system rare earth permanent magnet, which comprises a sintered body with a composition comprising of 25% to 35% by weight of R (wherein R represents one or more rare earth elements), 0.5% to 4.5% by weight of B, 0.02% to 0.5% by weight of Al and/or Cu, 0.03% to 0.25% by weight of Zr, 2% or less (excluding 0) by weight of Co, and the balance substantially being Fe, wherein the amount of oxygen is 2,000 ppm or less in said sintered body, and a mean grain size is between 3.5 and 5.0 μm in said sintered body, wherein Zr is dispersed in the grain boundary phase of said sintered body wherein the amount of nitrogen is 20 to 600 ppm and the amount of carbon is 1,500 ppm or less in said sintered body.

* * * * *